US006082088A

United States Patent [19]

Ohoka et al.

[11] Patent Number: 6,082,088

[45] Date of Patent: Jul. 4, 2000

[54] CLEANER FOR ROVING APPARATUS

[75] Inventors: Masanori Ohoka; Katsumi Nakane, both of Aichi-ken, Japan

[73] Assignee: Kabushiki Kaisha Toyoda Jidoshokki Seisakusho, Aichi-ken, Japan

[21] Appl. No.: 09/148,208

[22] Filed: Sep. 4, 1998

[30] Foreign Application Priority Data

| | | | |
|---|---|---|---|
| Sep. 5, 1997 | [JP] | Japan | 9-241377 |
| Sep. 5, 1997 | [JP] | Japan | 9-241378 |
| Oct. 6, 1997 | [JP] | Japan | 9-272930 |

[51] Int. Cl.[7] ..... D01H 11/00

[52] U.S. Cl. ..... 57/300; 19/262; 19/264; 57/67; 57/306; 57/315

[58] Field of Search ..... 57/300, 306, 315, 57/67; 19/262, 264

[56] References Cited

U.S. PATENT DOCUMENTS

| | | | |
|---|---|---|---|
| 1,252,180 | 1/1918 | Roberts | 57/300 |
| 3,924,397 | 12/1975 | Stahlecker et al. | 57/301 |
| 4,162,556 | 7/1979 | Van Ditshuizen et al. | 57/301 |
| 4,183,201 | 1/1980 | Stahlecker | 57/306 |
| 4,370,781 | 2/1983 | Murao | 19/265 |
| 5,901,543 | 5/1999 | Anthony | 57/301 |

FOREIGN PATENT DOCUMENTS

| | | | |
|---|---|---|---|
| 1510216 | 8/1969 | Germany | 19/265 |
| 58-13727 | 1/1983 | Japan . | |
| 63-106776 | 5/1988 | Japan . | |
| 11-42474 | 9/1989 | Japan . | |
| 1-266227 | 10/1989 | Japan | D01H 11/00 |
| 9-095830 | 4/1997 | Japan | D01H 5/64 |

*Primary Examiner*—William Stryjewski
*Attorney, Agent, or Firm*—Morgan & Finnegan, L.L.P.

[57] ABSTRACT

A cleaner for a roving apparatus which is free from an adverse effect caused by air flow blowing along an upper surface of a roller beam rearward of the roller beam, and which, after the fibers scraped from the bottom clearer cloth are collected to the rear of the roller beam, conveys the fibers to the end of an apparatus frame. The fibers, etc., adhered to the bottom clearer cloth are scraped by a scraper to fall onto a roller beam 1. The fallen fibers, etc., and the fiber waste which tends to be accumulated onto the upper surface of the roller beam are guided to a guide rail 25 by the action of air flow blowing from an air-blowing tube, to thereby accumulate on a bottom part 25*a* of the guide rail 25. The fibers, etc., are conveyed to the end of the guide rail 25 by a scraper 41 moving along the guide rail 25, and then collected in a dust box provided at the end of the apparatus frame. The bottom part 25*a* of the guide rail 25 is located lower than the upper surface of the roller beam 1. A wall 25*b* located at the opposite side from the roller beam 1 prevents the fibers, etc., from falling off from the guide rail 25.

20 Claims, 17 Drawing Sheets

CLEANER FOR ROVING APPARATUS

BACKGROUND OF THE INVENTION

1. Field of the Invention

The present invention relates to a cleaner for a roving apparatus, and in particular to a cleaner for a roving apparatus characterized in a carrying operation in which fiber waste and so on carried by air flow toward the rear of a roller beam is further conveyed to the end of the apparatus frame in order to prevent the fiber waste and so on from accumulating on a flyer rail and the roller beam.

2. Description of Related Art

In general, to clean roller groups of a draft apparatus in a roving apparatus, a top clearer cloth and a bottom clearer cloth are provided, which are rotated while being in contact with an upper roller group and a lower roller group, respectively. Both the clearer cloths are, in turn, cleaned by scrapers (scraping member) in contact with the clearer cloths which scrape the adhered fibers from the clearer cloths. The fibers (i.e. cotton dust) thus scraped from the top clearer cloth are removed manually by an operator or by a cleaner through a window provided on a cover located above the top clearer cloth.

On the other hand, the fibers thus scraped from the bottom clearer cloth fall onto a roller beam supporting a roller stand. The fallen fibers are then-carried by air flow, which blows toward a rear end of the roller beam from a blowing outlet provided at a front end of a flyer rail, until the fibers reach a suction duct or a belt conveyor provided rearward of the draft apparatus, with the result that the fibers are removed from the apparatus.

The apparatus in which the fibers are removed using the suction duct suffers from the following problems. That is, the fan motor consumes much electric power to generate a negative pressure in the suction duct, and the fiber waste accumulates on an upper portion of the suction duct. The presence of the suction duct hinders the maintenance around the roller parts (the bottom clearance, etc.) from a backside (a rear side) of the roving apparatus frame.

To solve these problems, Japanese Utility Model Laid-open No. 1-142474 discloses an apparatus, as shown in FIG. 28, in which a belt conveyor 72 is extended along a longitudinal direction of the apparatus frame rearward of a roller beam 71, and a cover 73 is disposed opposite from the roller beam 71 with respect to the belt conveyor 72 to prevent over-carrying of the fiber waste. In this apparatus, the air flow blowing out from an air-blowing tube 77 provided at a front end of the flyer rail 76 carries the fibers scraped from a bottom clearer cloth 74 and the fiber waste generated in a draft apparatus 75 and accumulating onto an upper surface of the flyer rail 76 or roller beam 71 (hereafter, the fibers and the fiber waste are simply referred to as the fibers, etc., when applicable), so that the fibers, etc., accumulate on the belt conveyor 72. Then, the fibers, etc., are conveyed by the conveyor 72 to the end of the apparatus frame where they are removed from the belt conveyor 72 by a removing device (not shown) at the end of the apparatus frame.

On the other hand, Japanese Patent Laid-open No. 58-13727 discloses another apparatus as shown in FIG. 29. In this apparatus, a pair of wheels (pulleys) 79 are provided on an apparatus frame 78 lowered by one step from a rear end of a roller beam 71, and an endless tape 80 is suspended between the wheels 79. A cloth (not shown) is attached to the tape 80. The rotation of the wheels 79 causes the movement of the tape 80 along the roller beam 71, and the fibers, etc., are engaged with the cloth running along with the tape 80, to thereby be conveyed to the end of the apparatus frame 78 where the fibers, etc., are sucked by a suction duct (not shown) provided at the end of the apparatus frame 78.

In the apparatus disclosed in Japanese Utility Model No. 1-142474 (see FIG. 28), the upper surface of the belt conveyor 72 on which the fibers, etc., accumulate is arranged to be at the same level as the upper surface of the roller beam 71, and the cover 73 for preventing the over-carrying of the cotton dust is disposed to project upward from the upper surface of the belt conveyor 72. Consequently, the stronger air flow blowing out from the air-blowing tube 77 may blow up the fibers, etc., by impinging on the cover 73. An adjustment of the blowing air flow to avoid this phenomenon is troublesome.

The apparatus disclosed in Japanese Patent Laid-open No. 58-13727 (see FIG. 29) is free from the aforementioned problem associated with the air flow blowing out from the air-blowing tube 77. However, the absence of a wall opposite from the roller beam 71 with respect to the apparatus frame 78 lowered by one step from-the roller beam 71 results in the high possibility that some of the fibers, etc., may fall from the apparatus frame 78 when the fibers, etc., accumulating on the apparatus frame 78 are engaged with and conveyed by the cloth moving along with the tape 80. Further, the fibers, etc., are likely to fall from the apparatus frame 78 by being hit by air flow blowing out from a performs so-called traveling cleaner which performs cleaning operation by blowing air flow therefrom while travelling along a spinning machine frame. Moreover, since the apparatus is designed to move the fibers, etc., with very soft material such as cloth, if the amount of the fibers, etc., is large, it is difficult to convey the fibers, etc., against the friction of resistance between the fibers, etc., and the apparatus frame 78 or the roller beam 71.

The present invention has been made to overcome the aforementioned problems, and therefore an object of the present invention is to provide a cleaner for a roving apparatus, which is free from the adverse effects caused by air flow blowing along an upper surface of a roller beam toward the rear of the roller beam, and which is capable of collecting the fibers, dust, leaf rag, etc. removed from a bottom roller and the fiber waste, etc. to be accumulated onto a flyer rail and the roller beam (fibers, dust leaf rag, fiber waste, etc. are hereafter referred to simply as fibers, etc., when applicable) to the rear of the roller beam, and conveying the fibers to the end of an apparatus frame where the fibers, etc., are collected.

SUMMARY OF THE INVENTION

To attain the above-described object, according to a first aspect of the present invention, a cleaner for a roving apparatus including a bottom roller cleaning device for cleaning at least one bottom roller of a draft apparatus is comprised of: a guide rail disposed along a longitudinal direction of an apparatus frame and located rearward of a roller beam supporting the draft apparatus, the guide rail including: a bottom part located below an upper surface of the roller beam; and a wall, located opposite from the roller beam with respect to the bottom part, for preventing the fall of fibers, conveying means for conveying the fibers, guided to the bottom part of the guide rail, to an end of the guide rail with an engagement portion moving along the guide rail; and a collecting portion, located at an end of the apparatus frame, for collecting the fibers conveyed by the conveying means to the end of the apparatus frame.

In the above-noted arrangement, the cleaning for the bottom roller of the draft apparatus is carried out by the bottom roller cleaning device. The fibers removed from the bottom roller by the bottom roller cleaning device fall downward of the bottom roller. The fallen fibers and the fiber waste (fibers, etc.) to be accumulated onto the upper surface of the flyer rail or the roller beam are carried by the action of the air flow to the guide rail located behind the roller beam. The fibers, etc., guided to the bottom part of the guide rail are conveyed to the end of the guide rail with the engagement portion moving along the guide rail, and collected in the collection portion provided at the end of the apparatus frame. Since the bottom part of the guide rail is located lower than the upper surface of the roller beam, the fibers, etc., which are guided to the bottom part of the guide rail are not adversely affected by the aforementioned air flow. The wall of the guide rail located at the side opposite from the roller beam prevents the fibers, etc., from falling off from the guide rail.

According to a second aspect of the present invention, an upper end of the wall for preventing the fall of fibers is lower than the upper surface of the roller beam. The wall for preventing falling with this arrangement can suppress the adverse effect caused by the air flow blowing from a traveling cleaner. Therefore, the fiber waste accumulated on the bottom part of the guide rail is prevented from being partially blown upwind to the slivers provided above.

According to a third aspect of the present invention, in the first or second aspect of the invention, the width of the guide rail decreases toward the bottom part. Therefore, the fibers, etc., guided to the guide rail can be collected easily to the central portion of the guide rail, and conveyed to the end of the guide rail even if the width of the scraping member is small.

According to a fourth aspect of the present invention, in any one of the first to third aspects of the invention, the conveying means includes: an endless belt extended above the guide rail, and suspended between a drive pulley and a driven pulley respectively provided at first and second ends of a spinning machine frame; and at least one scraping member, larger in width than the endless belt and fixed to the belt to be moved together with the belt, for conveying the fibers accumulated at least on the bottom part of the guide rail, to the end of the guide rail.

With this arrangement, the fibers, etc., accumulated at least on the bottom part of the guide rail are conveyed to the end of the guide rail by the scraping member fixed to the endless belt. Therefore, the width of the belt can be reduced to a half thereof or less in comparison with the case where a belt conveyor is used for conveyance, and thus the consumed power can be reduced.

According to a fifth aspect of the present invention, in the fourth aspect of the invention, the at least one scraping member includes: a bottom part cleaning scraping member for conveying the fibers accumulated on the bottom part of the guide rail, to the end of the guide rail; and a wall cleaning scraping member for conveying the fibers accumulated on the wall of the guide rail, to the end of the guide rail.

With this arrangement, the fibers, etc., accumulated on the bottom part of the guide rail can be conveyed to the end of the guide rail by the bottom part cleaning scraping member. The fibers, etc., accumulated on the wall of the guide rail are conveyed to the end of the guide rail by the wall cleaning scraping member.

According to a sixth aspect of the present invention, in the fifth aspect of the invention, the wall cleaning scraping member is made of flexible material, and the bottom part cleaning scraping member is made of material which has greater rigidity than the material of the wall cleaning scraping member.

Therefore, when the scraping members pass through the interference positions with the brackets supporting the drive pulley or the driven pulley, the scraping members are deformed easily to move while avoiding the brackets. After the scraping members pass over the interference positions with the brackets, the scraping members are restored to their original shapes.

According to a seventh aspect of the present invention, in any one of the fourth to sixth aspects of the invention, the drive pulley is driven by a motor dedicated as a drive source for the conveying means. Therefore, the arrangement is simple in comparison with an arrangement in which the drive pulley is driven through power transmission means by a drive source of the draft apparatus. There is no possibility of the fiber waste, etc., being wound up onto the power transmission means.

According to an eighth aspect of the present invention, in any one of the fourth to seventh aspects of the invention, each of the support shafts for the drive pulley and the driven pulley are provided horizontally.

The belt runs while being suspended on both pulleys under a condition that the width direction of the belt is parallel with the vertical direction. When the scraping member fixed to the belt conveys the fibers, etc., accumulated on the bottom part of the guide rail along the guide rail, the scraping member can be moved smoothly over the entire width of the bottom part even if the width of the bottom part is large.

According to a ninth aspect of the present invention, in any one of the fourth to seventh aspects of the invention, each of the support shafts for the drive pulley and the driven pulley is provided vertically.

With this arrangement, since the belt runs while being suspended between the pulleys under a condition that the width direction of the belt is vertical, the fibers, etc., barely accumulate on the belt.

According to a tenth aspect of the present invention, in any one of the first to ninth aspects of the invention, a cleaner for a roving apparatus further comprises: a guide plate, located below the bottom roller cleaning device and inclined downward toward the guide rail, for guiding the fibers to be removed and fall from the bottom rollers, to the guide rail, wherein a lower end of the guide plate extends up to a position corresponding to a rear end of the roller beam, and wherein the lower end of the guide plate and the upper surface of the roller beam define a gap for smoothing air flow blowing along the upper surface of the roller beam toward the guide rail.

With this arrangement, the fibers, etc., removed and fallen from the bottom roller are guided to the fiber conveying means regardless of the presence or the absence of the air flow blowing toward the rear of the roller beam since the lower end of the guide plate extends obliquely downward at least to the position corresponding to the rear end of the roller beam. The gap is defined between the lower end of the guide plate and the upper surface of the roller beam, which smoothes the air flow blowing toward the aforementioned fiber conveying means along the upper surface of the roller beam. Consequently, the fiber waste cannot accumulate on the roller beam if the air flow blowing toward the rear of the roller beam exists.

According to an eleventh aspect of the present invention, in the tenth aspect of the invention, the bottom roller cleaning device includes a scraping member reciprocally movable in a direction perpendicular to an axial direction of the at least one bottom roller by driving means, and the guide plate is movable together with the scraping member.

Since the guide plate is moved together with the scraping member, the fibers falling onto the guide plate fall along the guide rail easier than where the guide plate is disposed stationary at a predetermined position.

According to a twelfth aspect of the present invention, in the tenth aspect of the invention, the bottom roller cleaning device includes: a bottom clearer cloth running while being kept in contact with the bottom roller; a scraping member, reciprocally movable in a running direction while being in contact with an outer periphery of the bottom clearer cloth, for scraping the fibers adhered to the bottom clearer cloth; and a compression member for compressing the fibers scraped from the bottom clearer cloth by the scraping member, in cooperation with at least one of the scraping member and the bottom clearer cloth as the scraping member is moved toward a leading end thereof.

With this arrangement, since the scraped fibers are compressed, the cleaner is free from the problem encountered in the conventional device in that the scraped fibers are suspended downward in a long strip-like form. The scraped fibers are formed into a relatively-short worm-like fiber mass by the action of compression, fall onto the guide plate, and are guided along the upper surface of the guide plate to reach a position where the fiber conveying means is provided.

BRIEF DESCRIPTION OF THE DRAWINGS

FIG. 15 is a sectional view showing a general structure of a cleaner for a roving apparatus according to a fourth embodiment of the present invention with components partially omitted, in which

DESCRIPTION OF THE PREFERRED EMBODIMENTS

Preferred embodiments of the present invention, which are currently believed to be the best mode, will be described in detail with reference to the drawings attached hereto.

In the following description and drawings, functionally equivalent elements are designated by the same reference numbers. Note that relative terms such as 'right', 'left', 'up', 'down' and so on are used simply for convenience and should not be interpreted restrictively.

EMBODIMENT 1

Figure 1:
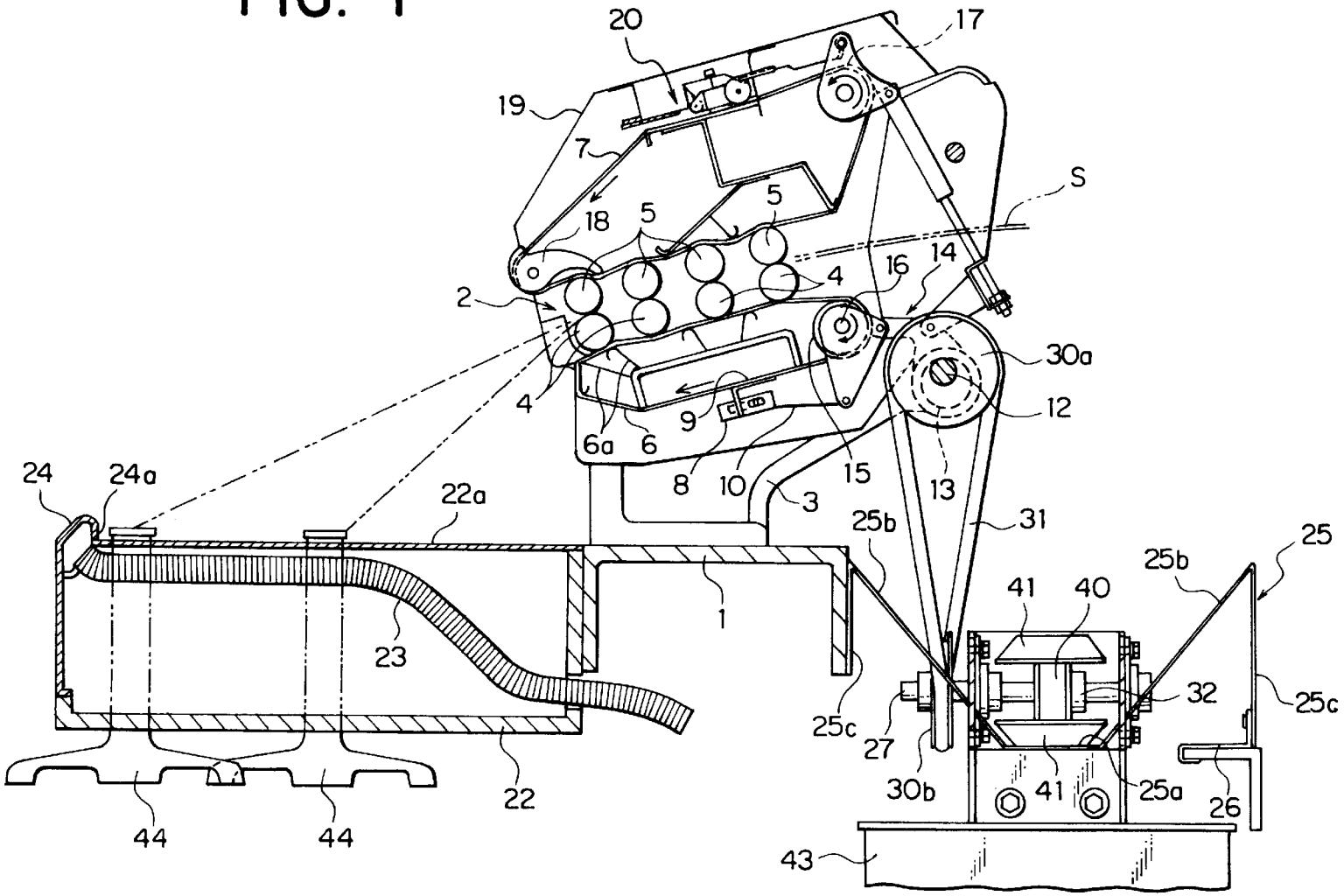
FIG. 1 is a partially-sectional schematic side view showing a general structure of a cleaner for a roving apparatus according to a first embodiment of the present invention.

A first embodiment of the present invention will now be described with reference to FIGS. 1 to 7. FIG. 1 is a partially-sectional side view showing a general construction of a cleaner for a roving apparatus according to a first embodiment of the present invention. As shown in FIG. 1, a draft apparatus 2 is supported through a roller stand 3 on a roller beam 1 constituting a frame of a roving apparatus. A roller part of the draft apparatus 2 includes bottom rollers 4 and top rollers 5. The top rollers 5 are biased by a waiting arm (not shown) to be pressed onto the bottom rollers 4. A bottom clearer cloth 6 and a top clearer cloth 7 are brought into pressure-contact with surfaces of fiber restricting sections of the bottom rollers 4 and top rollers 5, respectively, and travel around the rollers in that state.

Figure 4:
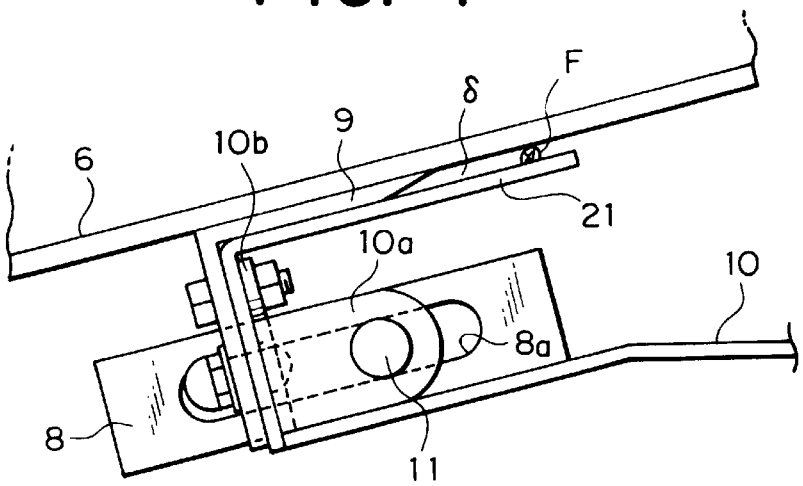
FIG. 4 is an enlarged view showing major structural portions of a bottom roller cleaning device comprised of a scraper, a compression member, etc.

FIG. 4 is an enlarged view of a portion of FIG. 1, where a scraper and a compression member are disposed. As shown in FIGS. 1 and 4, a bracket 8 having an elongated hole 8*a* is disposed below the bottom clearer cloth 6, and a support member 10 is disposed so as to be reciprocally movable along the elongated hole 8*a* with the aid of a pair of support pieces 10*a* protruded from the support member 10 and a pin 11 inserted into the elongated hole 8*a*. The support member 10 supports a scraper 9 serving as a scraping member for scraping fibers adhered to the bottom clearer cloth 6. The support member 10 is reciprocated by a cam/link mechanism 14 (disclose, for instance, by Japanese Patent Laid-open No. 9-958830, the disclosures of which are incorporated herein by reference) in association with rotation of an eccentric cam 13 rotated together with a drive shaft 12. A pulley 15, on which the bottom clearer cloth 6 is rotatably suspended, is supported by a rotary shaft 16, which is intermittently rotated through a one-way clutch (not shown) with the drive of the aforementioned cam/link mechanism 14. The bottom clearer cloth 6 suspended on the pulley 15 and guide members 6*a* is also intermittently rotated in a clockwise direction in FIG. 1. The scraper 9 constitutes a cleaning part for the bottom clearer cloth 6. A bottom roller cleaner is constructed by the bottom clearer cloth 6, the scraper 9 and so on.

The top clearer cloth 7 is suspended between a pulley 17 and a guide member 18 such that a rear half (a rear side from a substantially central part) of an upper running section extends substantially horizontally. A cover 19 for covering the top clearer cloth 7 is provided above the top clearer cloth 7, and a cleaning part 20 (disclosed in Japanese Patent Laid-open No. 9-95830) for the top clearer cloth 7 is provided in the cover 19.

As shown in FIGS. 1 and 4, the scraper 9 is formed into an L-shape in a side view, and fixed to a mounting piece 10*b* bent-formed on a leading end of the support member 10. A compression member 21 included in the bottom roller cleaner is fixed to the scraper 9 so as to be moved together. The compression member 21 is fixed to the scraper 9 to form a gap from the bottom clearer cloth 6 (in this embodiment, the compression member 21 is in contact with the lower surface of the scraper 9). This arrangement is the same as an apparatus disclosed in Japanese Patent Laid-open No. 9-95830.

As shown in FIG. 1, the upper surface of the roller beam 1 is flush with the upper surface of a cover 22*a* included in a flyer rail 22. An air-blowing tube 24 is extended along the entire length of the flyer rail 22 at the front upper end of the cover 22*a* (i.e. the front upper end of the flyer rail 22), the air-blowing tube 24 being communicated with an air-blowing duct (not shown) through a flexible tube 23. A large number of air-blowing nozzles 24*a* (only one is shown in FIG. 1) are formed in the air-blowing tube 24 so that the air flow blows out therefrom toward the rear of the roller beam 1 along the upper surface of the flyer rail 22.

Figure 3:
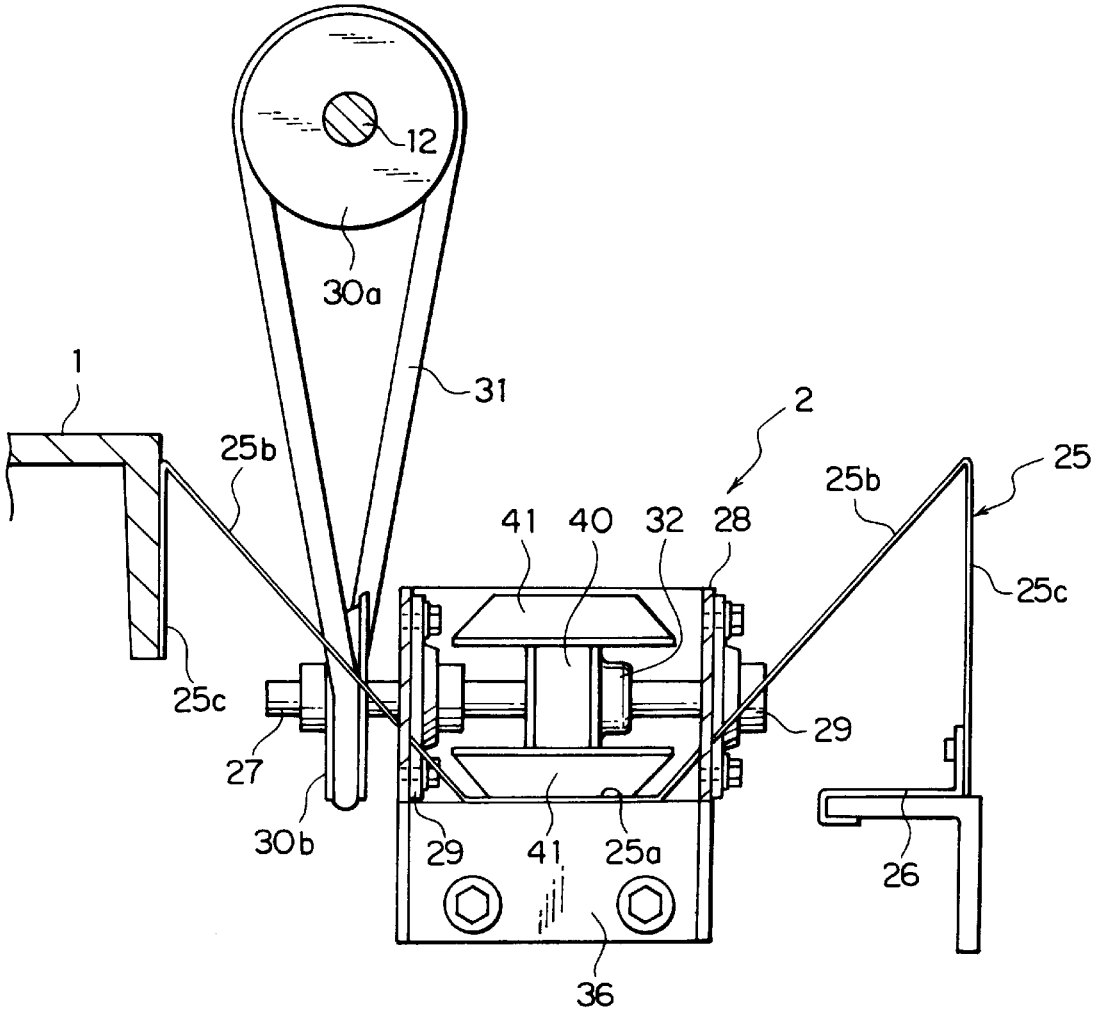
FIG. 3 is a partially enlarged side view showing a structural portion of the conveying means in FIG. 1.

FIG. 3 is an enlarged side view of a conveying means in the roving apparatus shown in FIG. 1. As shown in FIGS. 1 and 3, a guide rail 25 is disposed rearward of the roller beam 1, and extended in a longitudinal direction of the apparatus frame (i.e. in a direction orthogonal to the paper surface of FIG. 1 or 3). The guide rail 25 includes a horizontal part 25*a* (i.e. a bottom part) at its central portion, walls 25*b* (i.e. side walls) each extending obliquely upward from the horizontal part 25*a* in each side of the horizontal part 25*a*, and mounting parts 25*c* each extending downward from an upper end of each wall 25*b*. These parts are bent-formed and continuous with one another so that the guide rail 25 has a substantially M-shape in section. The guide rail 25 is fixed to the roller beam 1 and a support bracket 26 by the mounting parts 25*c* so that a groove substantially trapezoidal in section is defined behind the roller beam 1. That is to say, the guide rail 25 is arranged such that the bottom part 25*a* is located lower in height than the upper surface of the roller beam 1 and the groove width is decreased toward the bottom part 25*a*. The wall 25*b* located opposite from the roller beam 1 with respect to the bottom part 25*a* serves as a wall which prevents the fibers, etc., from falling off from the guide rail 25 to the opposite side from the roller beam 1.

Figure 2:
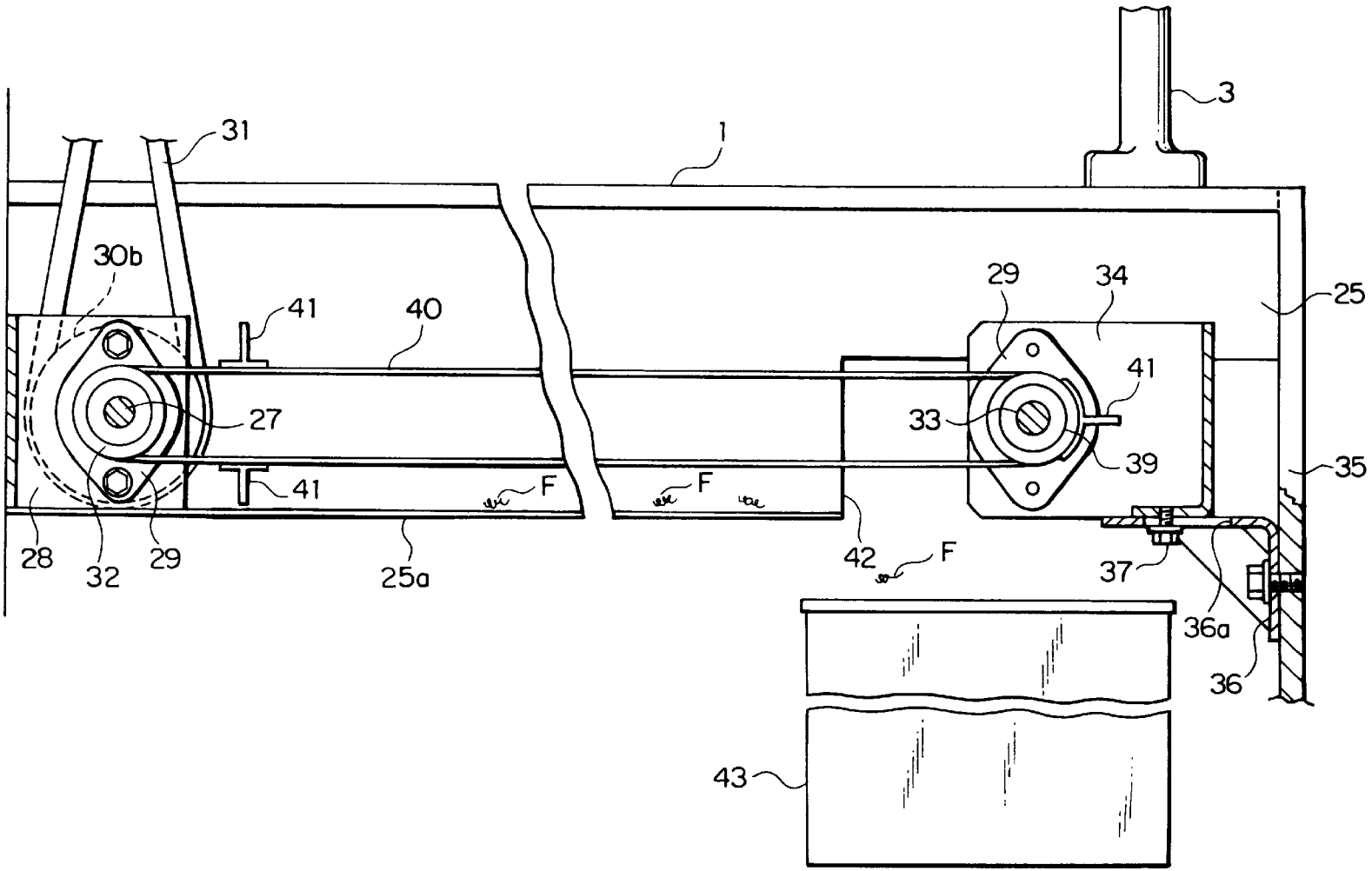
FIG. 2 is a partially-sectional schematic side view showing conveying means.
Figure 5:
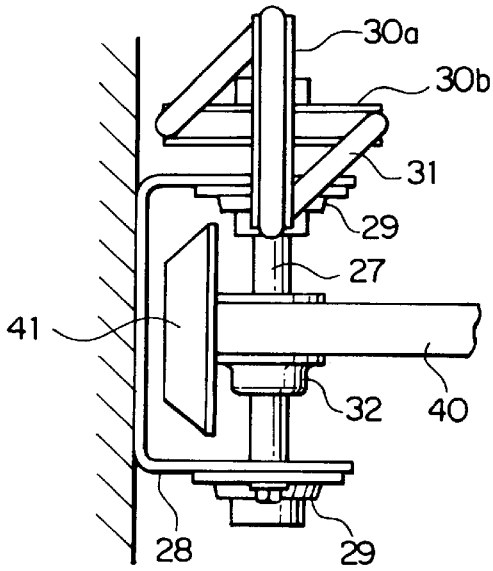
FIG. 5 is a plan view showing power transmission means in the gear end side with components partially omitted.

FIG. 2 is a partially sectional, schematic side view showing the conveying means in the cleaner, and FIG. 5 is a schematic plan view showing power transmission means in a gear end with components partially omitted. As shown in FIGS. 1 to 3 and 5, a support shaft 27 is rotatably supported on a first end of the apparatus frame (i.e., the gear-end side in this embodiment, and the left side in FIG. 2) through a bearing unit 29 fixed to the bracket 28. The support shaft 27 extends horizontally in a direction perpendicular to the longitudinal direction of the apparatus frame, i.e. in a direction perpendicular to the drive shaft 12. A pulley 30*b* is fixed to the support shaft 27 to be rotated together and is located at a position confronted with the drive shaft 12. A pulley 30*a* is fixed to the drive shaft 12 to be rotated together therewith. A rounded belt pulley is used for each of the pulleys 30*a* and 30*b*, and an endless rounded belt 31 is suspended between the pulleys 30*a* and 30*b*. The wall 25*b* of the guide rail 25 is formed with a notch (not shown) at a position corresponding to the pulley 30*b* and the support shaft 27 so as to avoid interference with the pulley 30*b* and the support shaft 27. A drive pulley 32 is fixed to the support shaft 27 so as to be rotated together therewith. The drive pulley 32 is fixed to be confronted with the bottom part 25*a*. Note that the guide rail 25 is omitted in the illustration of FIG. 5.

Figure 6:
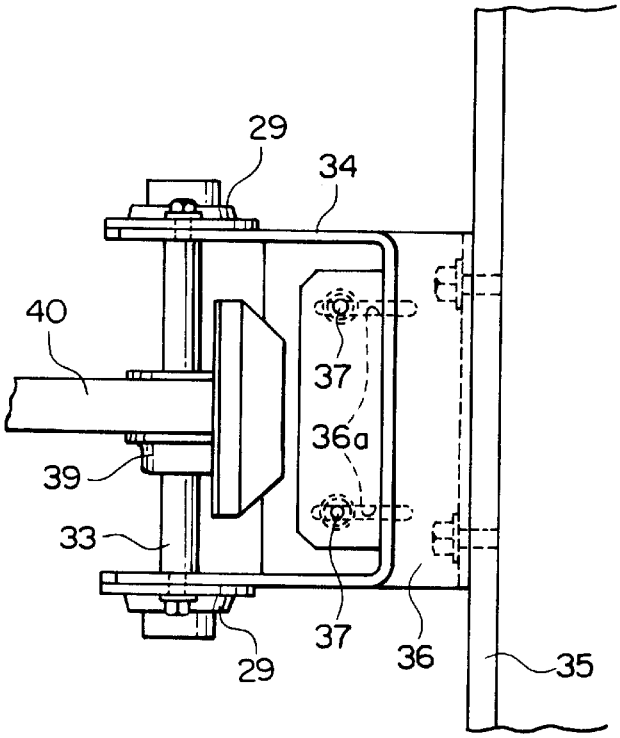
FIG. 6 is a plan view showing the conveying means in the outer end with components partially omitted.
Figure 7:
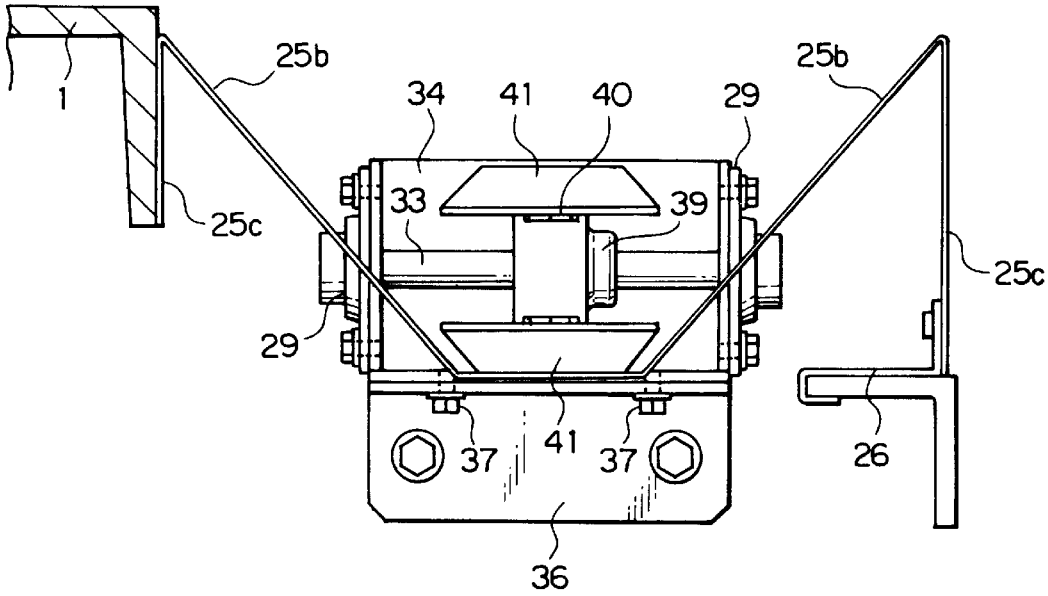
FIG. 7 is a sectional view showing a supporting state of a driven pulley in the outer end.

FIG. 6 is a schematic plane view showing an outer end side of the conveying means with components partially omitted, and FIG. 7 is a sectional view showing how to support a driven pulley at the outer end side. As shown in FIGS. 2, 6 and 7, a support shaft 33 is rotatably supported on a second end of the apparatus frame (an outer end side in this embodiment) through a bearing unit 29 fixed to a bracket 34. The bracket 34 is fixed to a bracket 36 fixed to a frame 35 such that the relative position therebetween is adjustable, to make it possible to adjust a position where the bracket supports the support shaft 33 along the longitudinal direction of the apparatus frame. The bracket 34 is formed with a threaded hole which corresponds in position to an elongated hole 36*a* formed through the bracket 36. The bracket 34 is fixed to the bracket 36 by a bolt 37 passed through the elongated hole 36*a* and screwed into the threaded hole. A driven pulley 39 is fixed to the support shaft 33 at substantially the center thereof so as to be rotated together therewith. The driven pulley 39 serves as a tension pulley.

An endless belt 40 is suspended between the drive pulley 32 and the driven pulley 39. The belt 40 is smaller in width than the bottom part 25*a*. A plurality of scrapers 41 are fixed on the outer periphery of the belt 40, each of which serves as an engagement portion and a scraping member. Each of the scrapers 41 is larger in width than the belt 40. As shown in FIGS. 1 and 3, the scraper 41 has a trapezoidal shape, whose distal end is slightly smaller in width than the bottom part 25*a*. The scraper 41 has such a height as to form a gap from the bottom part 25*a* of the guide rail 25 when the scraper 41 is located to be confronted with the bottom part 25*a*. The pulleys 32 and 39, the belt 40 and the scrapers 41 cooperatively form the conveying means for conveying the fibers, etc., which have been guided to the bottom part 25*a* of the guide rail 25, along the guide rail 25 to the end of the guide rail 25.

The number of scrapers 41 should not particularly be limited, and should be selected appropriately depending on the quantity and kind of yarn to be spun (for example, 100% cotton spinning, mixed fiber spinning, or man-made fiber spinning). The amount of fiber waste is largest in case of the 100% cotton spinning and smallest in case of the man-made fiber spinning, and medium in case of the mixed fiber spinning. Therefore, if the number of scrapers 41 in the case of the mixed fiber spinning is considered as a reference or standard, the 100% cotton spinning requires more scrapers 41 and the man-made fiber spinning requires less scrapers 41. For example, the apparatus frame for 120 bobbins requires five scrapers 41 in case of the standard type, six in case of the 100% cotton spinning and four in case of the man-made fiber spinning.

As shown in FIG. 2, a notch 42 is formed in the outer end side end portion of the guide rail 25 to extend from the bottom part 25*a* to each of the walls 25*b*. A dust box 43 is disposed below the notch 42 to serve as a collecting part. The dust box 43 is in the form of a box the upper portion of which is opened.

Operation of the apparatus thus constructed will be described. When the roving apparatus starts operating, slivers S are supplied to and drafted by the draft apparatus 2, and then wound up onto bobbins (not shown) through flyers 44. The drive shaft 12 is rotated in a constant direction, so that the bottom clearer cloth 6 together with the rotary shaft 16 and the pulley is rotated intermittently in a direction indicated by an arrow in FIG. 1 with the aid of cam/link mechanism 14. The top clearer cloth 7 is also rotated intermittently in a direction indicated by an arrow in FIG. 1. When the slivers S are drafted by the draft apparatus 2, a small quantity of short fibers (hereafter, referred to simply as fibers when applicable) are adhered onto the bottom rollers 4 and the top rollers 5. The fibers adhered onto the bottom rollers 4 and the top rollers 5 attach to the bottom clearer cloth 6 and the top clearer cloth 7 so as to be removed from the rollers 4 and 5, respectively.

In conjunction with the rotation of the-eccentric cam 13, the scraper 9 is reciprocated while being kept in contact with the bottom clearer cloth 6, so that the fibers F attached to the bottom clearer cloth 6 are scraped by the scraper 9 as shown in FIG. 4. The fibers scraped from the bottom clearer cloth 6 are accumulated between the compression member 21 and the bottom clearer cloth 6. The backward movement (i.e. the leftward movement in FIGS. 1 and 4) of the scraper 9 is synchronous with the movement of the bottom clearer cloth 6, but the amount of the movement of the support member 10 is larger than the amount of the movement of the bottom clearer cloth 6. Consequently, if the fibers are accumulated to a certain degree, some of the fibers held between the compression member 21 and the bottom clearer cloth 6 are compressed and partially rotated when the scraper 9 is moved backward, to thereby form a fiber mass having a worm-like form. The worm-like fiber mass escapes from the leading end of the compression member 21 and falls downward onto the roller beam 1.

The air flow always blows out toward the rear of the roller beam 1 from the blowing nozzles 24*a* provided at the front end of the flyer rail 22. Therefore, the fiber waste and the fiber mass F(or fibers etc. F) falling onto the upper surfaces of the flyer rail 22 and the roller beam 1 are carried by the air flow to the guide rail 25 to fall onto the guide rail 25. The fibers, etc., F falling onto the guide rail 25 are moved along the wall 25*b* and accumulated in the bottom part 25*a*.

On the other hand, the rotation of the drive shaft 12 causes the rotation of the support shaft 27 and thus the drive pulley 32 through the pulleys 30*a* and 30*b* and the rounded belt 31, so that the scrapers 41 together with the belt 40 are moved along the longitudinal direction of the roller beam 1. When the scrapers 41, when moved from the gear end side of the apparatus frame to the outer end side thereof while confronting the bottom part 25*a* of the guide rail 25, engage with the fibers, etc., F accumulated in the bottom part 25*a* of the guide rail 25 and carry the fibers, etc., F along the guide rail 25.

That is, the fibers, etc., F accumulated in the bottom part 25*a* of the guide rail 25 are engaged with and conveyed by the scrapers 41 confronting the bottom part 25*a* of the guide rail 25 during the course of the movement of the scrapers 41 along the guide rail 25, so that the fibers reach the outer end side of the apparatus frame. When the fibers, etc., F are conveyed to a position corresponding in position to the notch 42 of the guide rail 25, the fibers, etc., F are disengaged from the scraper 41, fall in the dust box 43 and are collected within the dust box 43. When the fibers, etc., F accumulate in the dust box to some degree they are collected by an operator.

This embodiment provides the following effects:

(a) The fibers, etc., F, which are carried by the air flow to the guide rail 25, accumulate in the bottom part 25*a* of the guide rail 25 disposed lower than the upper surface of the roller beam 1, and then conveyed by the scraper 41 to the end of the guide rail 25. Consequently, there is no adverse effect in association with the air flow blowing along the upper surface of the roller beam 1 toward the rear of the roller beam 1;

(b) The wall 25*b* is provided in the guide rail 25 so as to prevent the fibers, etc., F from falling to the opposite side from the roller beam 1. Consequently, when the fibers, etc., F are moved to the end of the guide rail 25 by the action of the scraper 41, the fibers, etc., F are always prevented from falling laterally from the guide rail 25;

(c) Since the guide rail 25 has such a configuration that its width is decreased toward the bottom part 25*a*, the fibers, etc., F, which are guided to the guide rail 25, easily accumulate at the central portion of the guide rail 25, and even if the width of the scraper 41 is small, the fibers, etc., F can be conveyed efficiently to the end of the guide rail 25;

(d) The fibers, etc., F accumulated on the bottom part 25*a* of the guide rail 25 are conveyed by the scraper 41 fixed to the endless belt 40, to the end of the guide rail 25. Therefore, the width of the belt 40 can be reduced to less than half in comparison with a case where the belt conveyor is used for conveyance, and thus the consumed power can be reduced;

(e) Since the belt 40 runs while being suspended between the pulleys 32 and 39 in a state where its width direction is horizontal, the scrapers 41 fixed to the belt 40 can be moved smoothly over the entire width of the bottom part even if the bottom part is wide when the fibers, etc., F accumulated in the bottom part 25*a* of the guide rail 25 are conveyed along the guide rail 25;

(g) In cases where the fibers, etc. are conveyed by a belt conveyor, the fibers, etc. are likely to adhere to the surface of the belt conveyor even after the belt conveyer is inverted since the fibers, etc. accumulate on the belt conveyor in a thin layered form. However, in this embodiment, the scraper 41 presses and collects the fibers, etc., F accumulated in the bottom part 25*a* of the guide rail 25, and, conveys the thus collected fibers, etc., F along the guide rail 25. Consequently, the fibers, etc., F conveyed to the position corresponding to the notch 42 formed in the end of the guide rail 25 can fall easily and smoothly by the own weight into the dust box 43;

(h) Since the upper end of the guide rail 25 does not protrude above the upper end of the roller beam, maintenance of the bottom clearer cloth from the back side of the apparatus frame can be facilitated;

(i) The fibers are scraped from the bottom clearer cloth 6 by the scraper 9, and compressed by the action of the compression member 21 so that a thus-formed worm-like fiber mass falls therefrom. The fiber mass fallen onto the roller beam 1 can be more easily carried by the action of the air flow to the guide rail 25 than the strip-like cut fibers;

(j) Since the fibers scraped from the bottom clearer cloth 6 by the scraper 9 are compressed by the action of the compression member 21 so that the worm-like fiber mass falls therefrom, the fibers scraped from the bottom clearer cloth 6 are never suspended in a strip-like form. Therefore, a control plate can be dispensed with, which avoids a problem where the suspended fibers are adversely affected by the air flow to be wound up onto a drive part in the bottom clearance;

(k) The drive pulley 32 is driven by utilizing, as a drive source, a rotational torque of the drive shaft 12 which is a drive source for the bottom clearer cloth cleaning part. Therefore, in comparison with a case where a dedicated motor is provided, the need for electric wiring for the dedicated motor can be eliminated, and the pulley can be automatically driven as the apparatus is in operation.

EMBODIMENT 2

A second embodiment of the present invention will be described with reference to FIGS. 8 to 11. The major differences of this embodiment from the aforementioned embodiment are that a drive pulley is driven by a dedicated motor serving as a drive source of conveying means, and that support shafts for the drive pulley and a driven pulley are arranged perpendicularly. Further, this embodiment is different from the aforementioned embodiment in that a wall 25*b* of a guide rail 25 for preventing the fibers, etc., F from falling off is arranged so that its upper end is lower than the upper end of a wall 25*b* located on the roller beam 1. Note that functionally equivalent components between this embodiment and the aforementioned embodiment are designated by the same reference numbers, and the detailed description therefor is omitted here.

Figure 8:
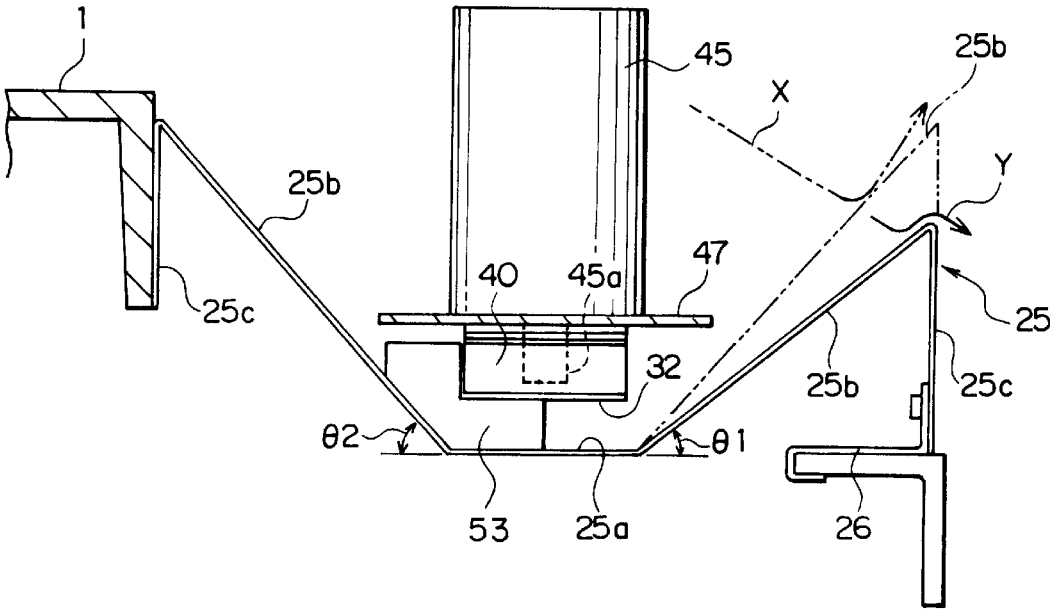
FIG. 8 is a sectional view showing major components in the gear end in a cleaner for a roving apparatus according to a second embodiment of the present invention.
Figure 9:
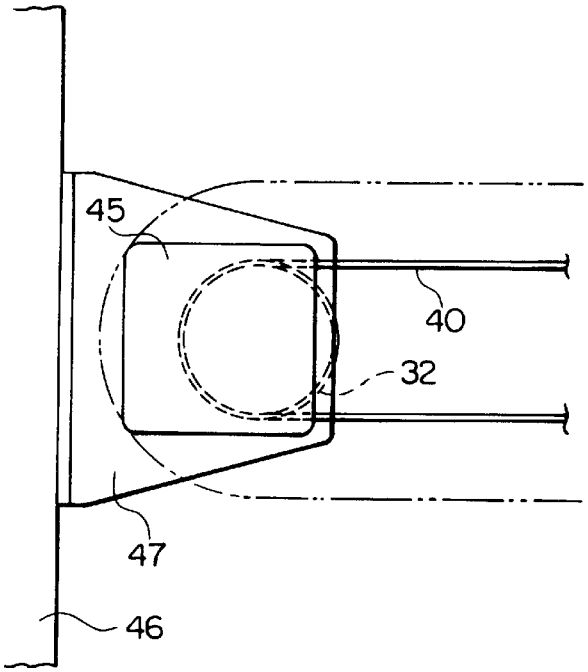
FIG. 9 is plan view of FIG. 8 with components partially omitted.

FIG. 8 is a sectional view of the gear end side for illustrating the conveying means in the second embodiment. FIG. 9 is a plane view of FIG. 8 with components partially omitted. As shown in FIGS. 8 and 9, a motor 45 is arranged above the gear end side of the guide rail 25 so that its output shaft 45*a* extends downward and perpendicularly. The motor 45 is fixed to a support bracket 47 fixed to the frame 46 of the gear end side. The pulley 32 is fixed to the output shaft 45*a* so as to be rotated together. In FIG. 9, the illustration for the guide rail 25 is omitted, and the locus of a scraper 53 is indicated by the broken line.

Figure 10:
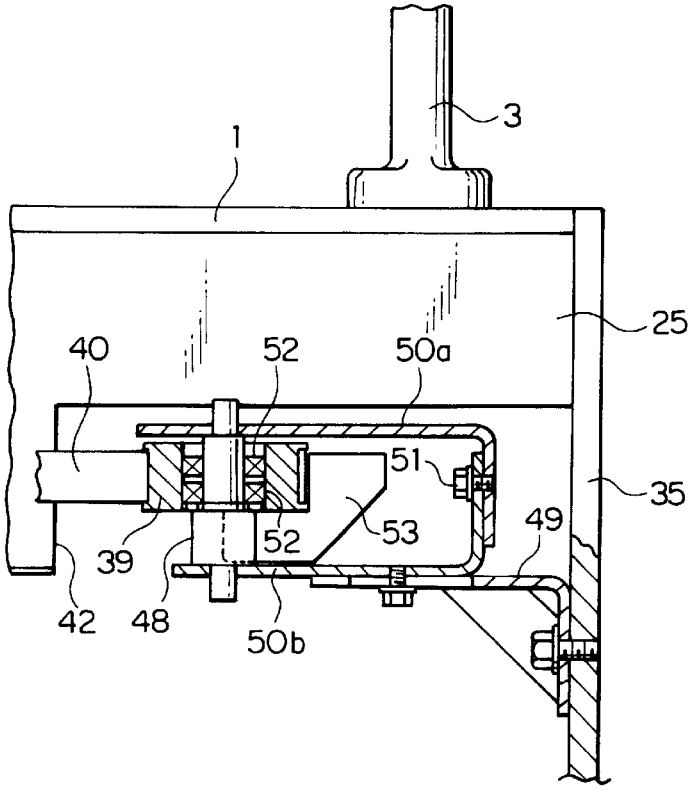
FIG. 10 is a sectional view showing conveying means in the outer end.
Figure 11:
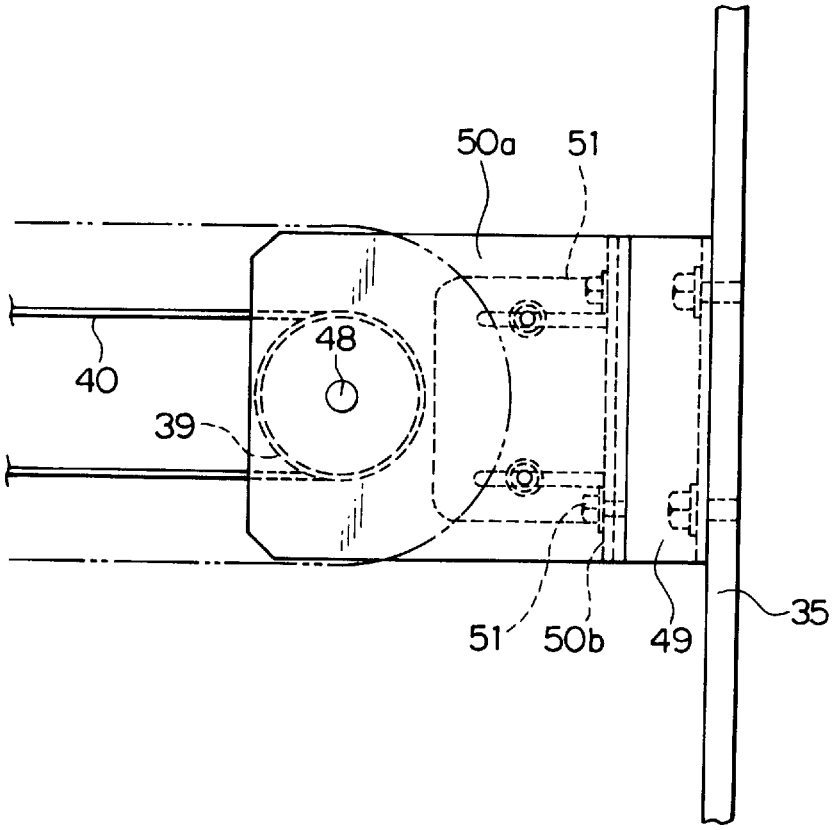
FIG. 11 is a plan view of FIG. 10 with components partially omitted.

FIG. 10 is a sectional view of the outer end side of the conveying means, and FIG. 11 is a plane view of FIG. 10 with components partially omitted. As shown in FIGS. 10 and 11, a stud 48 is arranged perpendicularly at a position corresponding to the notch 42 in the outer end side of the guide rail 25. The stud 48 serves as a support shaft which supports the driven pulley (i.e. a tension pulley) 39. The stud 48 is supported by the support brackets 50*a* and 50*b*, which, in turn, are adjustably coupled to a bracket 49 fixed to the frame 35 of the outer end side. Each of the support brackets 50*a* and 50*b* is in the form of a L-shape, and they are assembled together by a bolt 51 into a substantially U-shape to support both ends of the stud 48. The stud 48 is a stepped rod, and rotatably supports the driven pulley 39 through a bearing 52 positioned by an upper end face of its large diameter portion.

The belt 40 is suspended between the drive pulley 32 and the driven pulley 39 such that its width direction extends vertically. The scrapers 53 are fixed to the belt 40, each of which serves as an engagement portion and a scraping member. As shown in FIG. 8, the scraper 53 is designed to conform with a groove shape of the guide rail 25. More specifically, the scraper 53 substantially matches in shape with half of the bottom part 25*a* in the central portion of the guide rail 25 and the lower portion of the wall 25*b* located at the side of the roller beam 1.

As shown in FIG. 8, the walls 25*b* at both sides of the guide rail 25 are different in shape from each other, and the wall 25*b* located at the side opposite from the roller beam 1 is lower in height than the wall 25*b* located at the side of the roller beam 1. An angle θ1 between the horizontal part 25*a* and the wall 25*b* located at the side opposite from the roller beam 1 is smaller than an angle θ2 between the horizontal part 25*a* and the wall 25*b* located at the side of the roller beam 1.

In the conveying means thus constructed, the scraper 53 is moved along the bottom part 25*a* of the guide rail 25 along with the belt 40 as the motor 45 is driven. The scraper 53 is moved along the bottom part 25*a* of the guide rail 25 regardless of whether the scraper 53 is moved from the gear end side to the outer end side or from the outer end side to the gear end side. Therefore, the fibers, etc., F accumulated on the bottom part 25*a* of the guide rail 25 are first conveyed toward the gear end side, U-turned at the gear end side, and then conveyed toward the outer end side where they are collected into the dust box 43.

When the scraper 53 is U-turned at the outer end side, a leading end of the scraper 53 interferes with the stud 48 (as indicated by a broken line in FIG. 10), and is moved in sliding contact with the outer circumferential surface of the stud 48 while being bent, since the scraper 53 is flexible. After the fibers, etc., F are conveyed to the outer end side by the scraper 53 to be collected into the dust box 43, the scraper 53 is brought into sliding contact with the stud 48.

In general, a spinning factory is provided with a so-called traveling cleaner which carries out cleaning by air flow while traveling along spinning machine frames. The air flow from the traveling cleaner impinges obliquely downward onto the guide rail 25 as indicated by the broken line X in FIG. 8. If the wall 25*b* located at the side opposite from the roller beam 1 is high as indicated by the broken line, the air flow is directed upward by the wall 25*b* as indicated by the broken line arrow, so that some of fiber waste accumulated in the bottom part of the guide rail 25 is partially blown along up the walls 25*b* together with the air flow, and the fiber waste may eventually wind into the slivers S located above. In contrast, if the wall 25*b* located at the side opposite from the roller beam 1 is low, the air flow can be directed to advance across the upper end of the wall 25*b* toward the rear of the apparatus frame as indicated by the solid arrow Y.

This embodiment provides the following effects in addition to the effects (a) to (d) and (g) to (j) described in association with the first embodiment:

(l) Since the drive pulley 32 is driven by the dedicated motor 45, the structure can be made simple in comparison with the arrangement wherein the drive pulley 32 is driven through the power transmission means by the drive source of the draft apparatus 2 of the roving apparatus. There is no possibility of the fibers, etc., F winding in to the power transmission means, and thus the cleaning work is facilitated. Even when the roving apparatus is out of operation, the belt 40 is allowed to travel to collect the fibers, etc., F, and maintenance work is possible;

(m) Since the belt 40 travels such that its width direction extends vertically, the fibers, etc., F barely accumulate on the belt 40;

(n) The arrangement of the motor 45, in which its output shaft 45*a* extends horizontally, requires the formation of the notch for avoiding the interference between the guide rail 25 and the motor 45, and makes the mounting operation troublesome. However, the arrangement of the motor 45, in which its output shaft 45*a* extends vertically, eliminates the need for the notch and facilitates the mounting operation;

(o) Since the upper end of the wall 25*b* for preventing the fibers, etc., F from falling off is lower in height than the upper surface of the roller beam 1, it is possible to avoid the adverse effect by the air flow from the traveling cleaner, that is, to prevent the fiber waste from being partially blown up toward be wound into the slivers S.

EMBODIMENT 3

Figure 12:
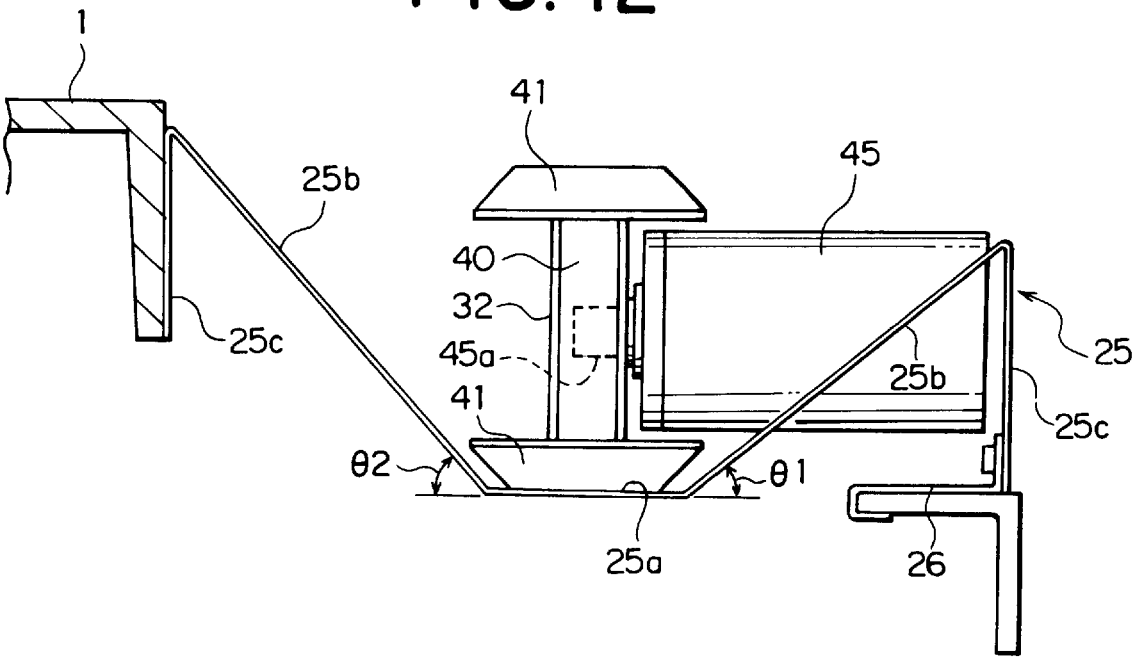
FIG. 12 is a sectional view showing major components in the gear end in a cleaner for a roving apparatus according to a third embodiment of the present invention.

A third embodiment of the present invention will be described with reference to FIGS. 12 to 14. The major difference of this embodiment from the first embodiment is that a drive pulley 32 is driven by a dedicated motor 45 serving as a drive source of the conveying means, and that the upper end of the wall 25*b* for preventing the fibers, etc., F from falling off from the guide rail 25 is lower in height than the wall 25*b* located at the side of the roller beam 1. The functionally equivalent components between this embodiment and the first embodiment are designated by the same reference numerals, and so the detailed description therefor is omitted here.

The configuration of the guide rail 25 is similar to that of the second embodiment. FIG. 12 is a sectional view of the gear end side of the conveying means according to the third embodiment. As shown in FIG. 12, the wall 25*b* located at the side opposite from the roller beam 1 is lower in height than the wall 25*b* located at the side of the roller beam 1. An angle θ1 between the horizontal part 25*a* and the wall 25*b* located at the side opposite from the roller beam 1 is smaller than an angle θ2 between the horizontal part 25*a* and the wall 25*b* located at the side of the roller beam 1.

Figure 13:
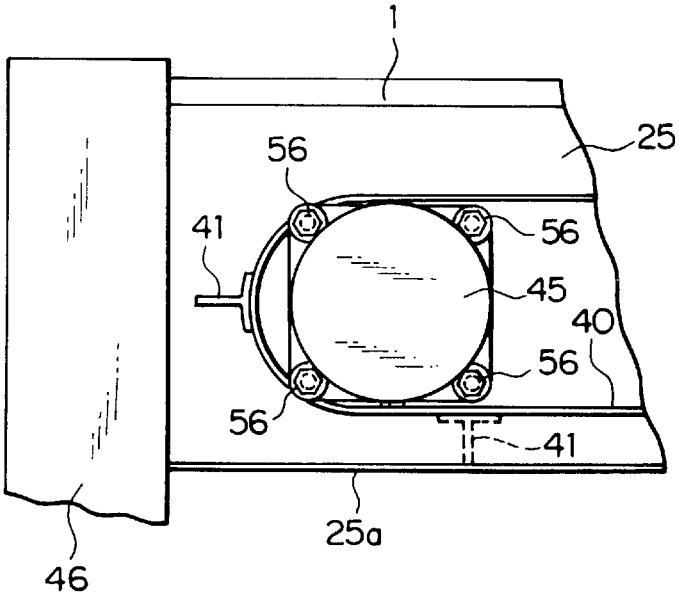
FIG. 13 is a side view of FIG. 12 with components partially omitted.
Figure 14:
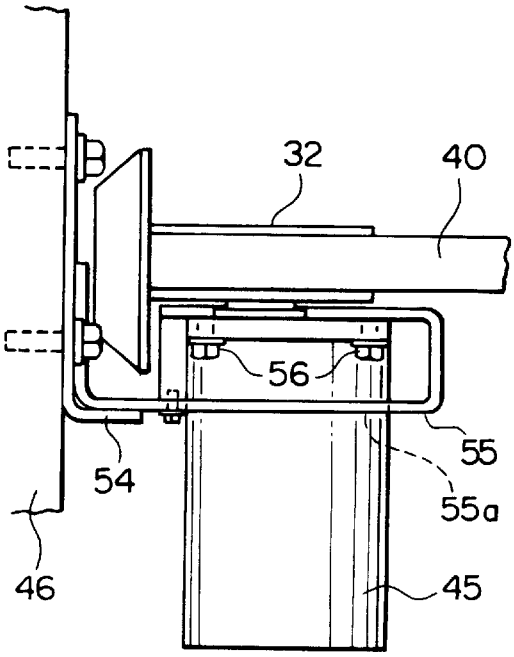
FIG. 14 is a plan view of FIG. 12 with components partially omitted.

FIG. 13 is a side view of the gear end side of the third embodiment with components partially omitted. As shown in FIGS. 12 and 13, a motor 45 is arranged in the gear end, side end portion of the guide rail 25 such that the motor 45 passes through a notch (not shown) formed in the guide rail 25. The output shaft 45*a* of the motor 45 extends horizontally. FIG. 14 is a plane view of the gear end side with components partially omitted similar to FIGS. 12 and 13. As shown in FIG. 14, the motor 45 is supported through a support bracket 55 by a bracket 54 fixed to the frame 46 of the gear end side. The support bracket 55 is provided with a hole 55*a* through which the motor 45 is inserted, and threaded holes with which bolts 56 are threadably engaged. The motor 45 is fixed to the support bracket 55 with the aid of four bolts 56. The drive pulley 32 is fixed to the output shaft 45*a* of the motor 45. In the outer end side, the driven pulley 39 is rotatably supported through a bearing by a support shaft extending horizontally. The belt 40 is suspended between the pulleys 32 and 39, and the scrapers 41 are fixed onto the belt 40. In FIGS. 12 and 13, the illustration for the bracket 54 and the support bracket 55 is omitted.

The conveying operation for the fibers, etc., F by the action of the scraper 41 in this embodiment is the same as that of the first embodiment. Therefore, this embodiment can provide the effects (a) to (j) described in association with the first embodiment. Since the configuration of the guide rail 25 is the same as that of the second embodiment, and the drive pulley 32 is driven by the dedicated motor 45, this embodiment can provides the effects (l) to (o) described in association with the second embodiment.

EMBODIMENT 4

A fourth embodiment will be described with reference to FIGS. 15 to 18. The major difference of this embodiment from each of the aforementioned embodiments is that this embodiment enables the removal of the fibers, etc., which are accumulated on the wall 25*b* of the guide rail 25 as well as a portion of the roller beam 1 closer to the guide rail 25 than the roller stand 3. More specifically, a scraping member 57 is mounted on the belt 40 to be contactable with the wall 25*b* entirely up to the upper end of the wall 25*b*, which is a difference from the third embodiment. The functionally equivalent components are designated by the same reference numeral, and the detailed description therefor is omitted here.

Figure 15A:
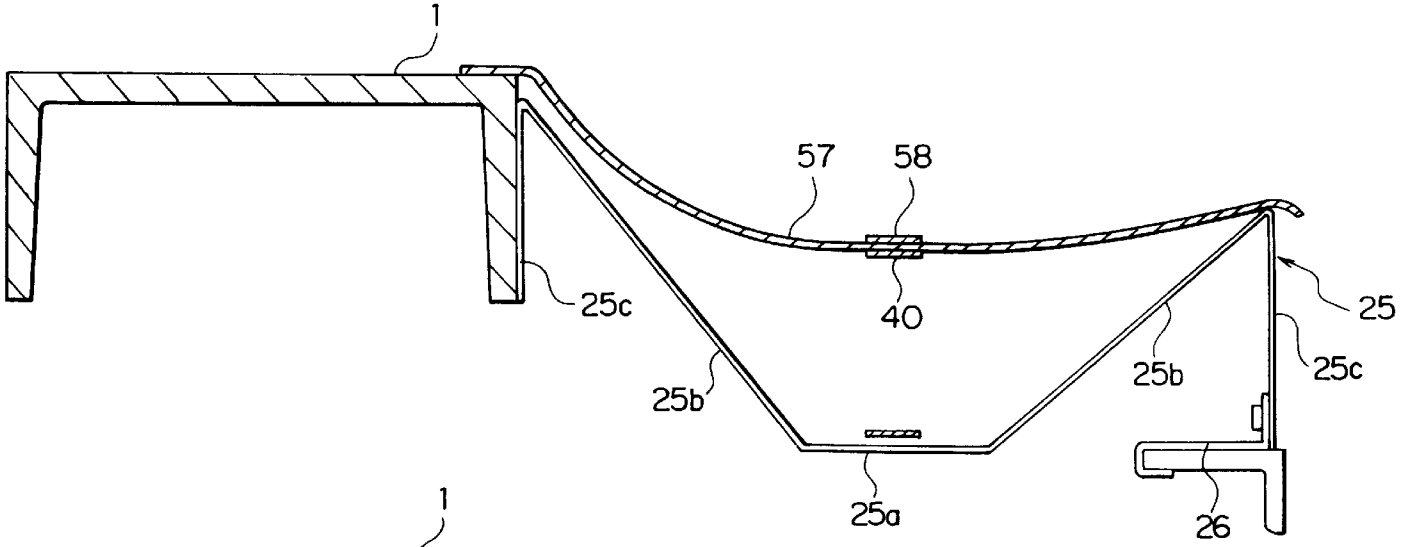
FIG. 15A illustrates a state where a scraping member mounted onto a belt is moved toward the gear end side.
Figure 15B:
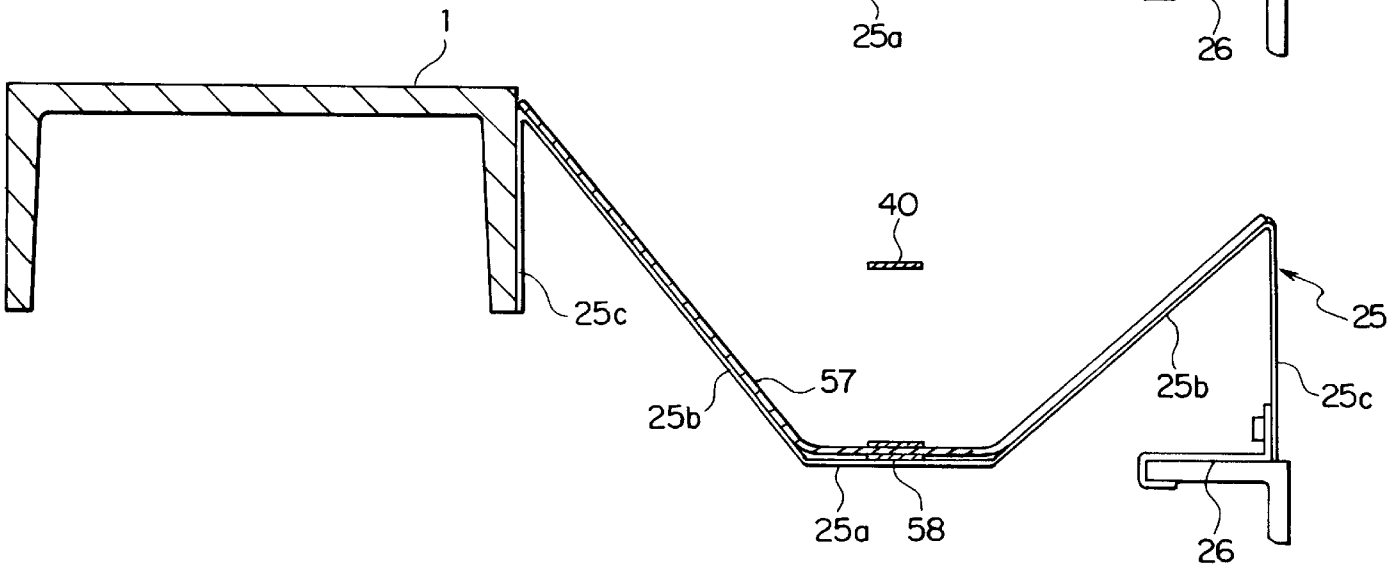
FIG. 15B illustrates a state where the scraping member is moved toward the outer end.
Figure 16:
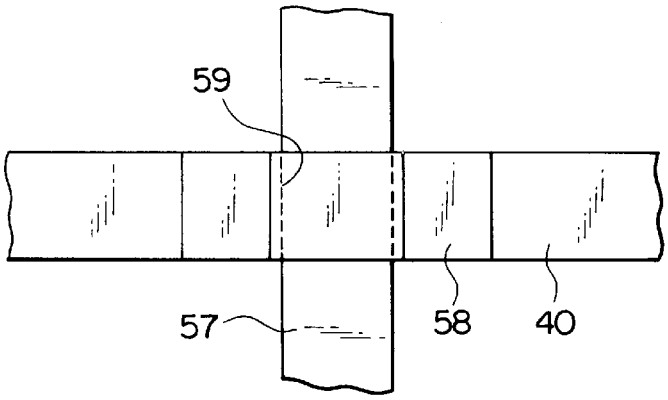
FIG. 16 is a partial plane view showing a mounting state of the scraping member onto the belt.
Figure 17:
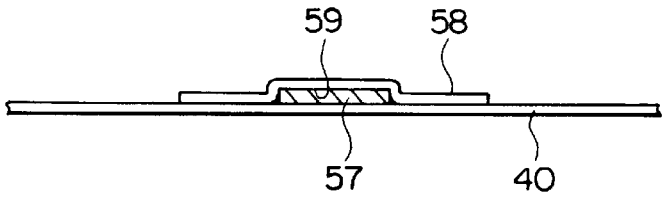
FIG. 17 is a partially-sectional side view of FIG. 16.
Figure 18:
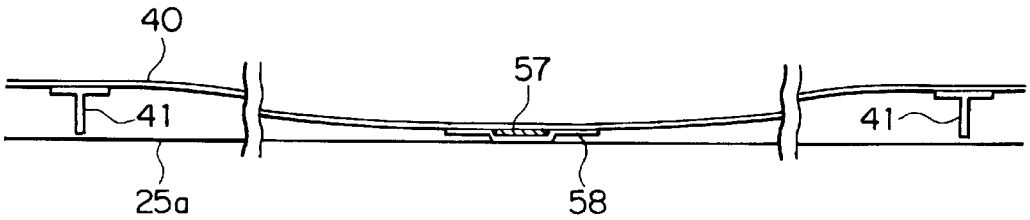
FIG. 18 is a schematic sectional side view showing a relationship among a scraping member, the belt, and scrapers.

FIG. 15A is a sectional view with components partially omitted, which illustrates a state where the scraping member 57 mounted on the belt 40 is moved toward the gear end side. FIG. 15B is a sectional view with components partially omitted, which illustrates a state where the scraping member 57 is moved toward the outer end side. In each of FIGS. 15A and 15B, the illustration for the driven pulley 39, the scraper 41, the support bracket 50*a*, etc. are omitted. The pulley scraping member 57 is mounted on the surface side of the belt 40 with the aid of an attachment 58. FIG. 16 is a plane view with components partially omitted, illustrating the mounting of the scraping member onto the belt, and FIG. 17 is a sectional view thereof with components partially omitted. As shown in these drawings, the scraping member 57 is inserted and fitted into a fitting hole 59 formed between the belt 40 and the attachment 58 fixed to the belt 40 so as to extends perpendicularly to the belt 40. The same numbers of scraping members 57 are provided as those of the scrapers 41 such that one scraping member 57 is located at substantially the mid-point between adjacent two scrapers 41. Since the fixing distance for the scraper 41 is about 6 mm, the looseness of the belt 40 allows the attachment 58 to be contacted with the horizontal part 25*a* as shown in FIGS. 15B and 18 when the scraping member 57 is moved along and in the vicinity of the bottom part 25*a*, that is, when the scraping member 57 is moved toward the outer end side. In this embodiment, the scraper 41 serves as a bottom part cleaning scraping member, whereas the scraping member 57 serves as a wall cleaning scraping member. The scraping member 57 can also serve as the bottom part cleaning scraping member.

The scraping member 57 is formed of flexible material so as to be deformable such that the scraping member 57 is extended along the bottom part 25*a* and both walls 25*b* of the guide rail 25 as shown in FIG. 15B when the scraping member 57 is moved toward the outer end side, whereas the scraping member 57 is contiguous with the upper surface of the roller beam 1 as shown in FIG. 15A when the scraping member 57 is moved toward the gear end side. In this embodiment, the scraping member 57 is made of the same material (for example, polyurethane) as the belt 40. The scraping member 57 has such a flexibility as to be deformed easily upon interference of the support brackets 55, etc. supporting the drive pulley 32 and the driven pulley 39, and restored easily after the scraping member 57 passes over these components. Appropriate width of the scraping member 57 depends on material and thickness, and in case of polyurethane and 1 to 4 mm thickness, the width is preferably selected to be 10 to 20 mm. In this embodiment, the scraping-member 57 has 15 mm in width, and is the same as the belt 40. As shown in FIGS. 15B, the scraping member 57 has such a length that each end thereof reaches the upper end of the corresponding wall 25*b* when the scraping member 57 is moved toward the outer end side.

The scraper 41 of this embodiment serves similarly to that of the third embodiment. The scraping member 57 is moved toward the outer end side while being in contact with the both walls 25*b* as shown in FIG. 15B so as to scrape the fiber waste, dust, leaf rag, etc. accumulated on the walls 25*b*. During the course of movement of the scraping member 57, some of the fibers, etc., Fall to the bottom part 25*a* and the others are conveyed to the outer end side to be collected in the dust box 43.

On the other hand, as shown in FIG. 15A, the scraping member 57 is moved toward the gear end side in such a manner that one end thereof is brought into contact with the upper surface of the portion of the roller beam 1 close to the guide rail 25, whereas the other end thereof is brought into contact with the apex (the upper end) of the wall 25*b* located at the side opposite from the roller beam 1. The air flow from the air blowing nozzles 24*a* and the air flow blowing out from the travelling cleaner generally prevent the fibers, etc., From being accumulated onto the upper surface of the roller beam 1, but such air flow hardly affects on the portion behind the roller stand 3 and thus the fibers, etc., may be accumulated on that portion. In this embodiment, when the scraping member 57 is moved toward the gear end side, the scraping member 57 conveys or transfers the fibers, etc., From behind the roller stand 3 to the area where the aforementioned air flows can be effected. Therefore, by the action of such air flow, the-fibers, etc., Fall off onto the guide rail 25.

When the moving direction of the scraping member 57 is changed at the gear end side or the outer end side, the scraping member 57 must pass over the position where it interferes with the support brackets 55, etc. supporting the drive pulley 32 or the driven pulley 39. At this time, the scraping member 57 is deformed into a shape which permits the scraping member 57 to pass through a small spatial gap between the support brackets 55, etc. and the guide rail 25, and restored into the original shape after the passage. Consequently, the above-noted operation is repeated.

The embodiment can provide the following effects in addition to the effects described in association with the third embodiment:

(p) It is possible to clean not only fibers, etc., accumulated on the bottom part 25*a* of the guide rail 25 but also fibers, etc., accumulated on the walls and apex portions of the guide rail 25 and the portion of the roller beam 1 behind the roller stand 3;

(q) Since the scraping member 57 can be mounted to the belt 40 by fittingly inserting the scraping member 57 in between the attachment 58 and the belt 40, the replacement is easily conducted.

EMBODIMENT 5

A fifth embodiment of the present invention will be described with reference to FIGS. 19 and 20. The major difference of this embodiment from the second embodiment is that cleaning for the fibers, etc., accumulated (stacking) on the wall 25*b* of the guide rail 25 is possible. More-specifically, the fifth embodiment is arranged such that a scraping member 60 is mounted on the belt 40 along the higher one of the walls 25*b* to be contactable with the upper end thereof, which is the difference from the second embodiment. The functionally equivalent components are designated by the same reference numeral, and the detailed description therefor is omitted here.

The scraping member 60 of this embodiment is formed of the same material as the scraping member 57 of the fourth embodiment. FIG. 19 is a sectional view showing the gear end side of the conveying means according to the fifth embodiment. The scraping member 60 is mounted onto the belt 40 by an attachment 61. FIG. 20 is a partial plane view showing a mounting state of the scraping member onto the belt. As shown in FIG. 20, the attachment 61 has such a shape as to define a fitting hole 62 between the attachment 61 and the belt 40, and is fixed to the belt 40 so that the fitting hole 62 extends in the width direction of the belt 40. The fitting hole 62 is smaller in width than the belt 40. The scraping member 60 is formed at its one end with a mounting portion 60*a* mating with the attachment 61. The mounting portion 60*a* is slightly smaller in width than the fitting hole 62, and the leading end of the mounting portion 60*a* is formed into a removal preventing portion 60*b* with which the mounting portion 60*a* cannot be removed from the fitting hole 62 unless it is pulled forcibly by a large force.

The appropriate width of the scraping member 60 depends on the material and thickness, and in this embodiment a width is selected that is slightly larger than the width of the belt 40. As shown in FIG. 19, the scraping member 60 is mounted onto the belt 40 in such a manner that a portion of the scraping member 60 close to the mounting portion 60*a* is bent. The scraping member 60 has such a length as to extend up to the upper end of the wall 25*b* of the roller beam 1 side when the scraping member 60 is extended along the that wall 25*b*. In this embodiment, the scraper 53 serves as the bottom part cleaning scraping member, whereas the scraping member 60 serves as the wall cleaning scraping member.

The scraper 53 of this embodiment operates similarly to that of the second embodiment. The scraping member 60 is moved toward the outer end side while being slid along the wall 25*b* of the roller beam 1 side as shown in FIG. 19, so that the scraping member 60 scrapes the fiber waste, dust, leaf rag, etc. (fibers, etc.) accumulated on that wall 25*b*. During the course of the movement of the scraping member 60, some of the fibers, etc., Fall off to the bottom part 25*a*, and the others are conveyed to the outer end side where they are collected in the dust box 43.

Figure 19:
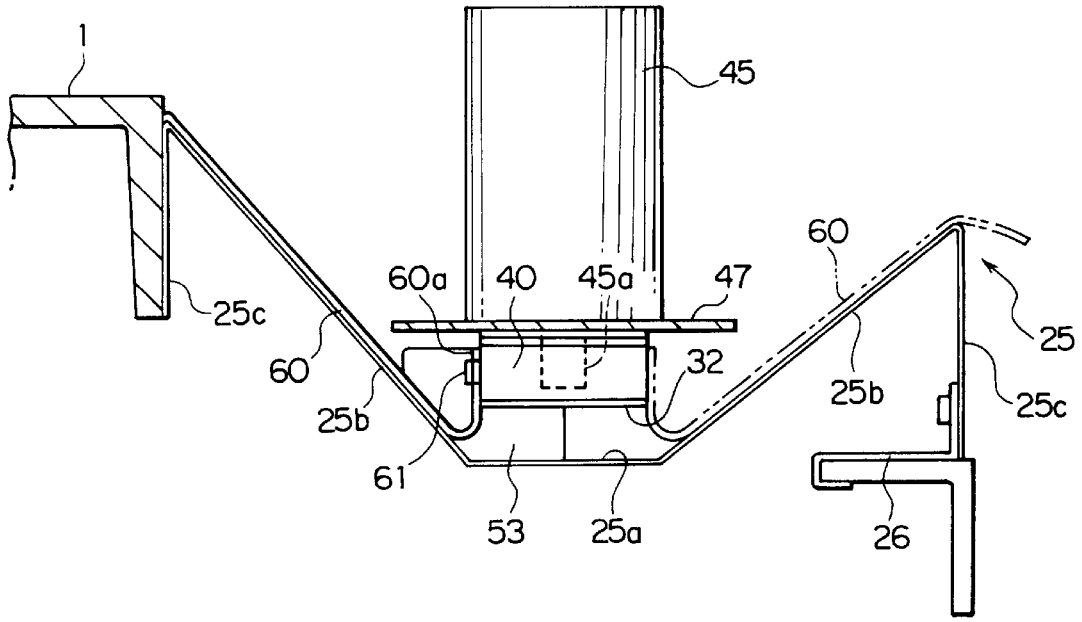
FIG. 19 is a sectional view showing the gear end of a cleaner for a roving apparatus according to a fifth embodiment of the present invention, with components partially omitted.
Figure 20:
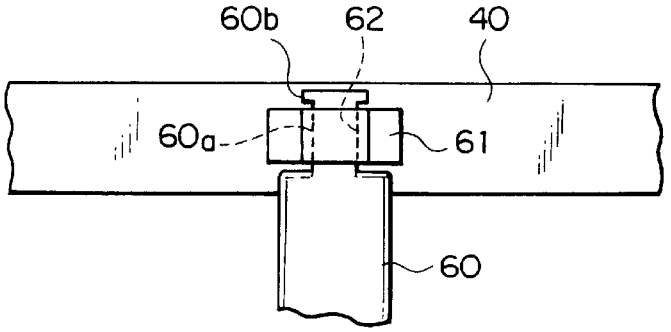
FIG. 20 is a partial plane view showing how a scraping member is mounted onto a belt.

On the other hand, the scraping member 60 is moved toward the gear end side while being in contact with the wall 25*b* located at the opposite side from the roller beam 1 as shown by a dotted line in FIG. 19. By this movement of the scraping member 60, the fibers, etc., are conveyed along the wall 25*b* to the gear end side where they fall onto the bottom part 25*a* of the guide rail 25 due to the inversion of the scraping member 60. Then the fibers, etc., are conveyed by the scraper 53 to the outer end side so as to be collected in the dust box 43.

This embodiment can provide the following effects in addition to the effect described in association with the second embodiment:

(r) It is possible to clean not only the fibers, etc., accumulated on the bottom part 25*a* of the guide rail 25 but also the fibers, etc., accumulated on the walls 25*b* of the guide rail 25;

(s) The scraping member 60 can be mounted to the belt 40 simply by the insertion of the scraping member between the attachment 61 and the belt 40. Thus, the replacement is easily conducted;

(t) Since the scraping member 60 has such a length as to be contacted with the upper and rear surfaces of the roller beam 1 when the scraping member 60 is moved along the roller beam 1 side, it is possible to clean the fibers, etc., accumulated on the roller beam 1 behind the roller stand 3.

EMBODIMENT 6

Figure 22:
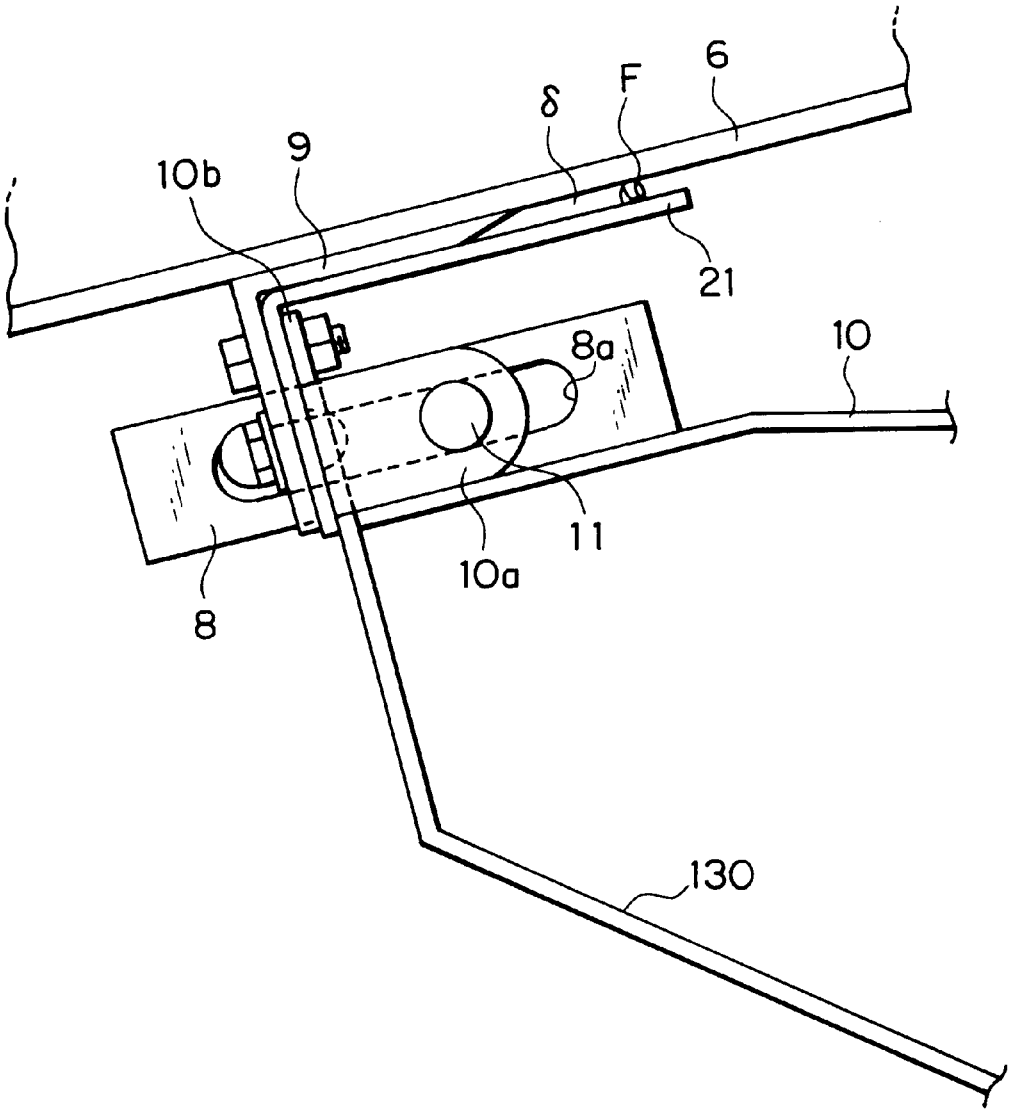
FIG. 22 is a structural view mainly showing a main portion of a guide plate mounted to a lower side of a bottom roller cleaning device.
Figure 23:
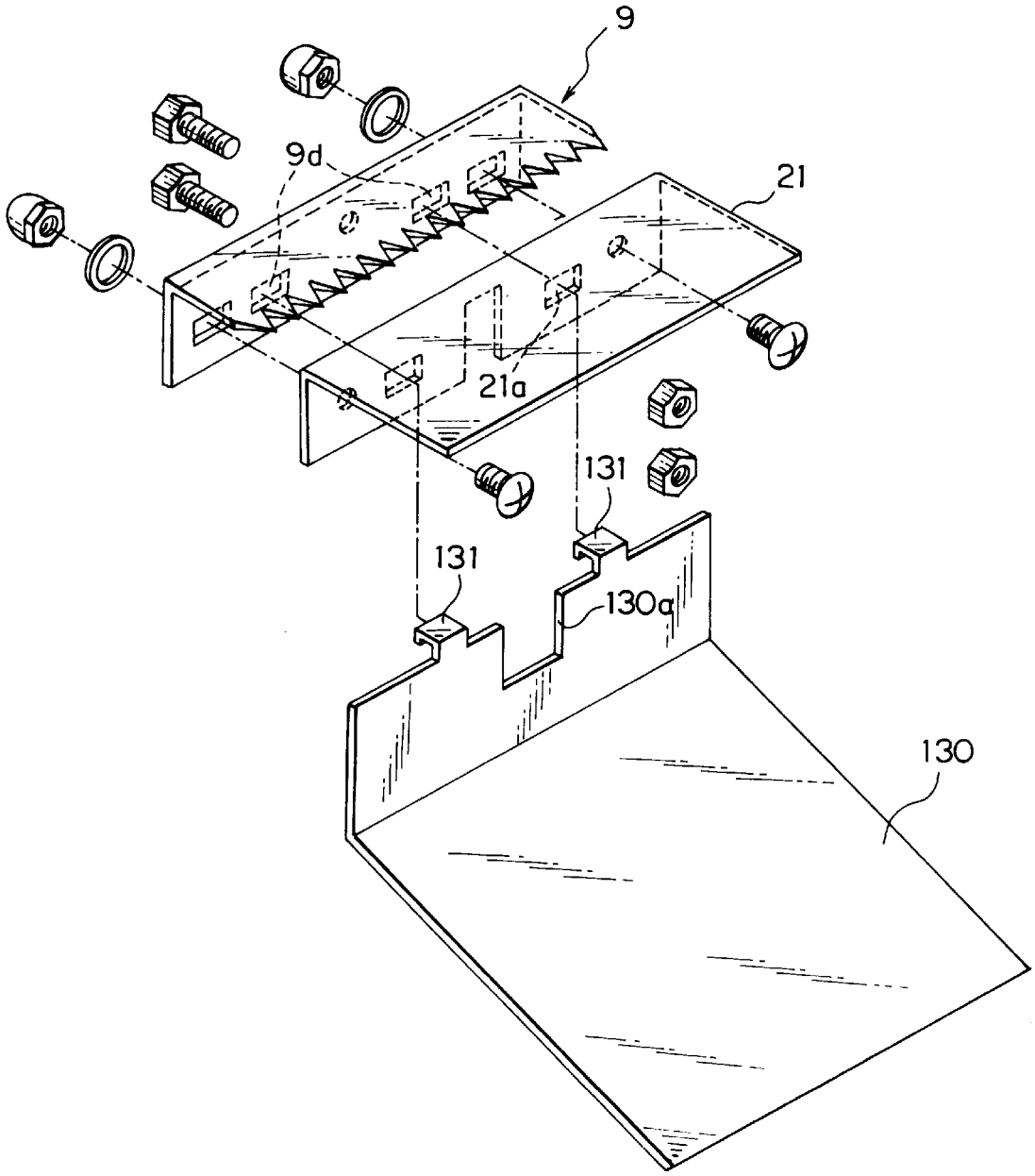
FIG. 23 is an exploded perspective view showing the structure of a scraper, a compression member and the guide plate.

A cleaner for a roving apparatus according to a sixth embodiment of the present invention will be described with reference to FIGS. 21 to 23. The major difference of this embodiment from the first embodiment is that a guide plate 130 is mounted onto a lower portion of the bottom roller cleaning device constituted by the bottom clearer cloth 6, scraper 9, etc. shown in FIG. 4. The functionally equivalent components are designated by the same reference numerals, and the detailed description therefor is omitted here.

Figure 21:
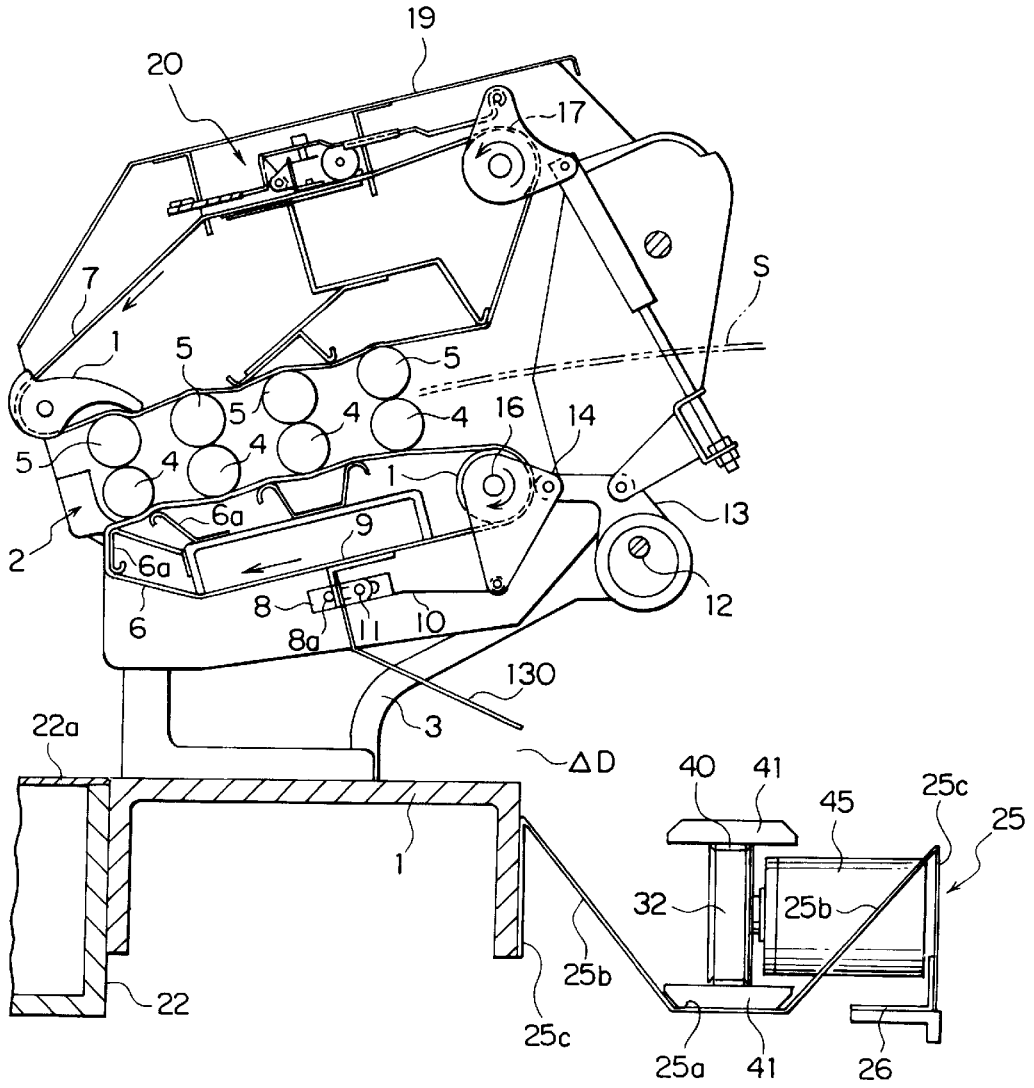
FIG. 21 is a partially sectional side view showing a general structure of a cleaner for a roving apparatus according to a sixth embodiment of the present invention.

FIG. 21 is a partially sectional side view showing a general arrangement of the roving apparatus to which the guide plate 130 is mounted onto the lower portion of the bottom roller cleaning device. FIG. 22 is an enlarged view mainly showing an arrangement of the guide plate 130. FIG. 23 is an exploded perspective view showing an arrangement of the scraper, the compression member and the guide plate.

As shown in FIG. 21, the guide plate 130 is provided on the lower portion of the draft apparatus 2 to guide the fibers scraped from the bottom clearer cloth 6 to the guide rail 25. The guide plate 130 is bent so that the upper portion thereof extends perpendicularly to the moving direction of the scraper 9 below the scraper 9 whereas the lower portion thereof extends obliquely downward toward the guide rail 25. The guide plate 130 is formed so that its lower end reaches, at least, a position corresponding to the rear end (the right end in FIG. 21) of the roller beam 1. The lower end of the guide plate 130 and the upper surface of the roller beam 1 cooperatively define a gap ΔD, which smoothens the air flow blowing along the upper surface of the roller beam 1 to the guide rail 25. The gap ΔD is set in a range of 10–20 mm, preferably in a range of 20 to 50 mm. In this embodiment, the gap ΔD is set at about 30 mm.

In this embodiment, the guide plate 130 is designed to be movable together with the scraper 9. As shown in FIG. 23, the guide plate 130 is formed at its upper end with hooks 131. A distal end of each hook 131 is bent at right angle to provide a bent portion positioned away from the guide plate 130 at a distance substantially corresponding to the sum of the thicknesses of the scraper 9 and the compression member 21. The hooks 131 are hooked to and engaged with the mating holes 9*d* and 21 formed through the scraper 9 and the compression member 21 to support and position the guide plate 130 in a predetermined inclination. The guide plate 130 is detachably attached such that its lower end is located at the position corresponding to the rear end of the roller beam 1 upon the completion of the rearward movement (the leftward movement in FIG. 21) of the scraper 9. In addition, a notch 130*a* is formed in an upper central portion of the guide plate 130 to avoid interference with the support member 10.

As described above, the fibers attached to the bottom clearer cloth 6 are scraped by the scraper 9 therefrom, and then accumulated between the bottom clearer cloth 6 and the compression member 21. The differential movement between the bottom clearer cloth 6 and the support member 10 allows the thus scraped fibers to be compressed into the worm-like fiber mass.

The worm-like fiber mass escapes from the distal end of the compression member 21, falls onto the guide plate 130, and then is moved along the guide plate 130 toward the guide rail 25, and falls onto the guide rail 25. The fiber mass fallen onto the guide rail 25 is moved along the wall 25*b* and thus accumulated on the bottom part 25*a*.

The lower end of the guide plate 130 is located at the position corresponding to the rear end of the roller beam 1 when the scraper 9 is in its rearmost position, and the lower end of the guide plate 130 is located above the guide rail 25 when the scraper 9 is in its foremost position. Accordingly, any fiber mass can be guided downward by the guide plate 130 to fall onto the guide rail 25.

The presence of the guide plate 130 allows the air flow to blow from the front end of the flyer rail 22 to the rear of the roller beam 1 without being dispersed. The fiber waste which is generated by the draft apparatus 2 and falls onto the upper surfaces of the flyer rail 22 and the roller beam 1, can thus be carried by the air flow to the guide rail 25 so as to be accumulated on the bottom part 25*a* of the guide rail 25.

The sixth embodiment can provide the following effect:

(u) Since the guide plate 130 extends to the position corresponding to the rear end of the roller beam 1, the fibers scraped from the bottom clearer cloth 6 can be surely guided to the bottom part 25*a* of the guide rail 25 located rearward of the roller beam 1 regardless of the presence or absence of the air flow blowing toward the rear of the roller beam 1;

(v) With the presence of the gap ΔD formed between the lower end of the guide plate 130 and the upper surface of the roller beam 1 so as to allow the air flow to smoothly blow along the roller beam 1 to the guide rail 25, the air flow blowing out from the air blowing nozzles can reach the position corresponding to the guide rail 25 without substantive dispersion, and thus the carrying performance for the fibers, etc., F can be enhanced. Consequently, the fiber waste falling onto the upper surfaces of the flyer rail 22 and the roller beam 1 can be carried to the guide rail 25 with high efficiency. The same carrying performance can be attained with reduced flow of the air flow from the air blowing nozzles;

(w) Where the cleaning portion for the bottom clearer cloth 6 is arranged to allow the fibers scraped from the bottom clearer cloth 6 to be suspended in a strip-like form in place of an arrangement where the fibers scraped from the bottom clearer cloth 6 are formed into a worm-like fiber mass, the presence of the guide plate 130 enables the problem where the suspended fibers are blown up by the virtue of the air flow blowing out from the air blowing nozzles to be avoided;

(x) Since the guide plate 130 reciprocates along with the scraper 9, the vibration caused by the reciprocation of the guide plate 130 facilitates the downward movement of the fibers fallen along the guide plate 130.

(y) The fibers scraped from the bottom clearer cloth 6 by the scraper 9 fall off after being compressed into a worm-like fiber mass F by the action of the compression member 21. Therefore, the fiber mass F falling onto the guide rail 130 is moved downward more easily along the guide plate 130 in comparison with the strip-like cut fibers.

Figure 24:
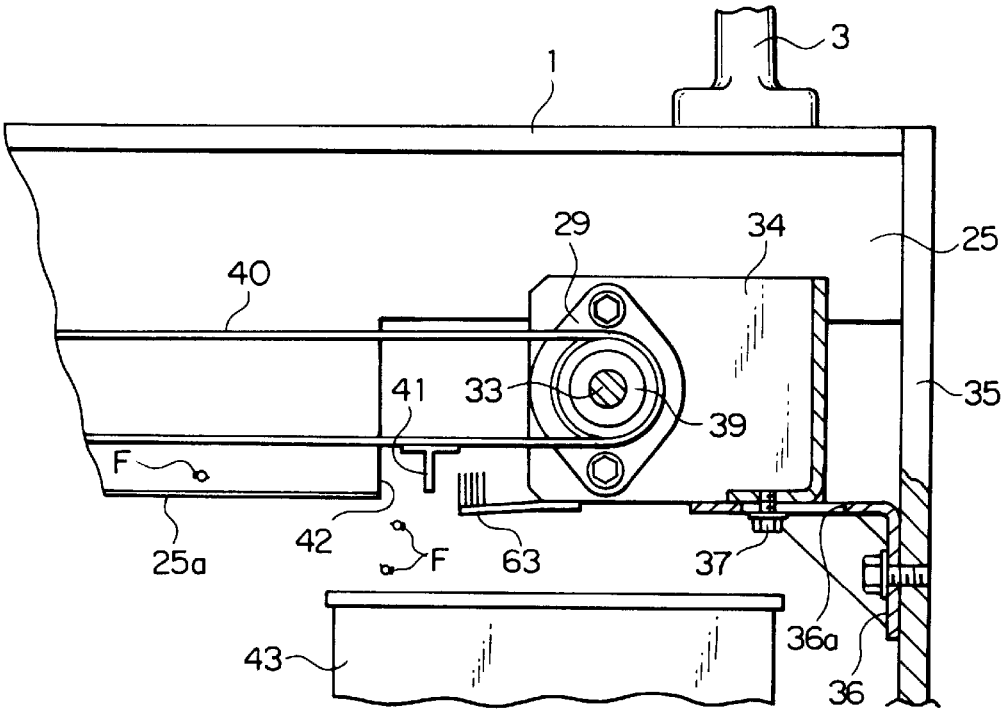
FIG. 24 is a sectional view of the outer end in another embodiment of the present invention.

The aforementioned embodiments should not be limited to specific structures described above, and may be modified as follows:

(i) As shown in FIG. 24, a brush 63 which can be engaged with the scraper 41 (53) may be arranged at a position corresponding to the position where the notch 42 is formed in the guide rail 25. In this case, after the scraper 41 disengages the conveyed fibers, etc., F therefrom, the scraper 41 passes through the portion where the scraper 41 is brought into contact with the brush 63. Therefore, even if the fiber waste remains partially adhered to the scraper 41, the contact with the brush 63 makes it possible to remove the adhered fiber waste from the scraper 41. Consequently, it is possible to eliminate increase in friction resistance between the scraper 41 and the guide rail 25 which may be caused by the fiber waste remaining wound up, and thus to avoid excessive power consumption.

Figure 25:
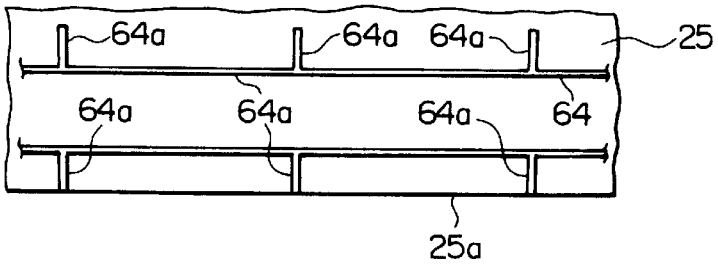
FIG. 25 is a schematic side view of a belt in another embodiment of the present invention.

(ii) In place of an arrangement that the scraper 41 is fixed to the belt 40, as shown in FIG. 25, an endless belt 64 may be used so as to be formed with protrusions 64*a* at predetermined intervals on the outer periphery thereof. In this arrangement, each of the protrusions 64*a* is used as a scraper. The number of steps to mount the scrapers 41 onto the belt 40 can be dispensed with, whereby the manufacturing cost may be reduced. In combination with the use of this belt 64, the scraping member 57 may be mounted thereto at predetermined intervals (for example, at meter intervals).

Figure 26A:
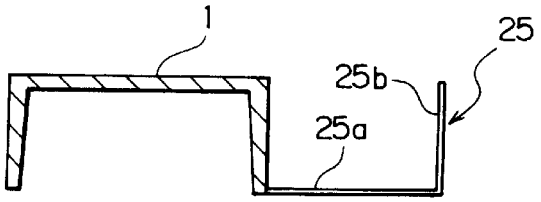
FIG. 26A is a sectional view showing a configuration of a guide rail in another embodiment of the invention.
Figure 26B:
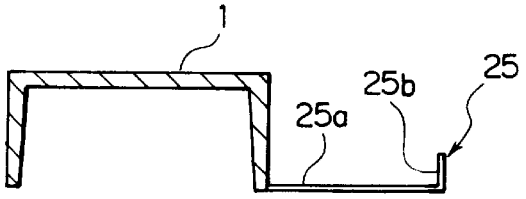
FIG. 26B is a sectional view showing a configuration of a guide rail in yet another embodiment of the invention.

(iii) Configuration of the guide rail 25 should not be restricted to the configuration that is tapered toward the bottom part 25*a* and may be modified as far as the guide rail 25 has the wall 25*b* located at the opposite side from the roller beam 1 to prevents the fibers, etc., F from falling off. For example, as shown in FIGS. 26A and 26B, the guide rail 25 may be formed simply into an L-shape. Each of these guide rail 25 can be manufactured with the reduced number of processing in comparison with the guide rail 25 of the first to third embodiments, and thus manufacturing cost can be reduced. Further, the same advantage can be applied to the L-shaped guide rail 25 in which the height of the wall 25*b* (for preventing the fibers, etc., F from falling) is made lower than the upper surface of the roller beam 1 as shown in FIG. 26B to eliminate the adverse effect caused by the air flow from the traveling cleaner. The guide rail 25 should not be limited to such a configuration as to have the bottom part 25*a* which is horizontal, and may be modified into a V-shape or an arcuate shape in section.

(iv) In place of an arrangement wherein the fibers, etc., F accumulated in the dust box 43 are collected manually by an operator, as in a device disclosed in Japanese Patent Laid-open. No. 1-266227, a bottom of the dust box may be communicated with a suction duct connected to a cotton gathering box, and an opening/closing valve may be provided midway to the dust box. The opening/closing valve is normally closed to prevent a negative pressure of the suction duct from acting on the fibers, etc., within the dust box, and the opening/closing valve is opened according to the need to apply the negative pressure of the suction duct onto the fibers, etc., within the dust box. In this arrangement, when the fibers, etc., are collected to a certain degree within the dust box, the opening/closing valve is opened for a predetermined time period to apply the vacuum effect of the suction duct to the fibers, etc., within the dust box, whereby the fibers, etc., are automatically collected from the dust box.

(v) Without the use of the scrapers 41 and 53, a belt conveyor may be extended along the bottom part of the guide rail as the conveying means for conveying the fibers, etc., F, which are guided to the bottom part 25*a* of the guide rail 25, along the guide rail 25 to the end of the guide rail 25. In this case, since the upper surface of the belt conveyor can serve as the bottom of the guide rail, the walls 25*b* may be extended along the belt conveyor without the provision of the horizontal bottom part of the guide rail 25.

(vi) An arrangement disclosed in Japanese Patent Laid-open No. 9-95830 may be adopted to form the fibers scraped from the bottom clearer cloth 6 into a worm-like fiber mass.

(vii) In the first embodiment of the present invention, a bottom roller (a back bottom roller) of the draft apparatus 2 may be used as a drive source for driving the drive pulley 32, without the use of the drive source (the-drive shaft 12) of the cleaning part for the bottom clearer cloth 6.

(viii) As the bottom roller cleaning device, a scratcher contactable with a lower portion of each bottom roller may be moved through a drive machine as in a device disclosed in Japanese Utility Model Laid-open No. 63-106776, in place of the arrangement wherein fibers removed from the bottom rollers 4 by the bottom clearer cloth 6 are scraped from the bottom clearer cloth 6 by the scraper 9.

(ix) In place of the roller beam 1 having a planar portion on which the roller stand 3 stands, the roller beam 1 may be comprised of a plurality (for example, two) of cylindrical pipes or rods, and the roller stand 3 is mounted under a state where the roller beam 1 is held between the roller stand 3 and a clamping member. In this case, a guide plate is required between the flyer rail 22 and the guide rail 25.

(x) In the fourth or fifth embodiment of the present invention, the scraping members 57 or 60 may be fixed directly with adhesive agent or secured with screws onto the belt 40 without the use of the attachments 58 or 61. In this case, the manufacturing cost is made smaller relative to the case where the attachment is used.

(xi) In the fourth embodiment of the present invention, only the scraping members 57 need be mounted onto the belt 40 without using the scrapers 41. In this case, the kind of required components can be reduced, and troublesome mounting work can be reduced accordingly.

(xii) Without provision of the air blowing nozzles 24 at the front end of the flyer rail 22 from which air flow blows to the rear of the roller beam 1 along the upper surface of the flyer rail 22, the air flow from the traveling cleaner mounted on the spinning apparatus frame may be used to carry the fibers, etc., to the guide rail 25.

(xiii) In the sixth embodiment of the present invention, the guide plate 130 may be removably fixed to a predetermined position in place of an arrangement that the guide plate 130 is provided to be moved integrally with the scraper 9.

Figure 27:
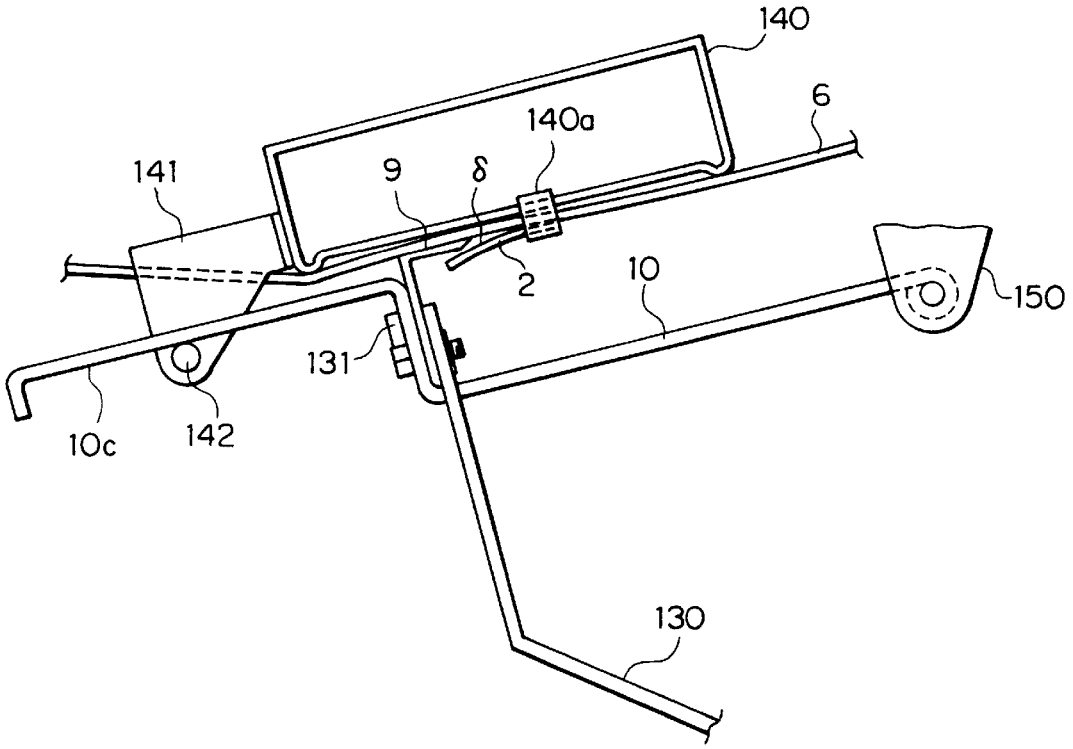
FIG. 27 is a structural view showing a mounting state of a guide plate in another embodiment of the invention.
Figure 28:
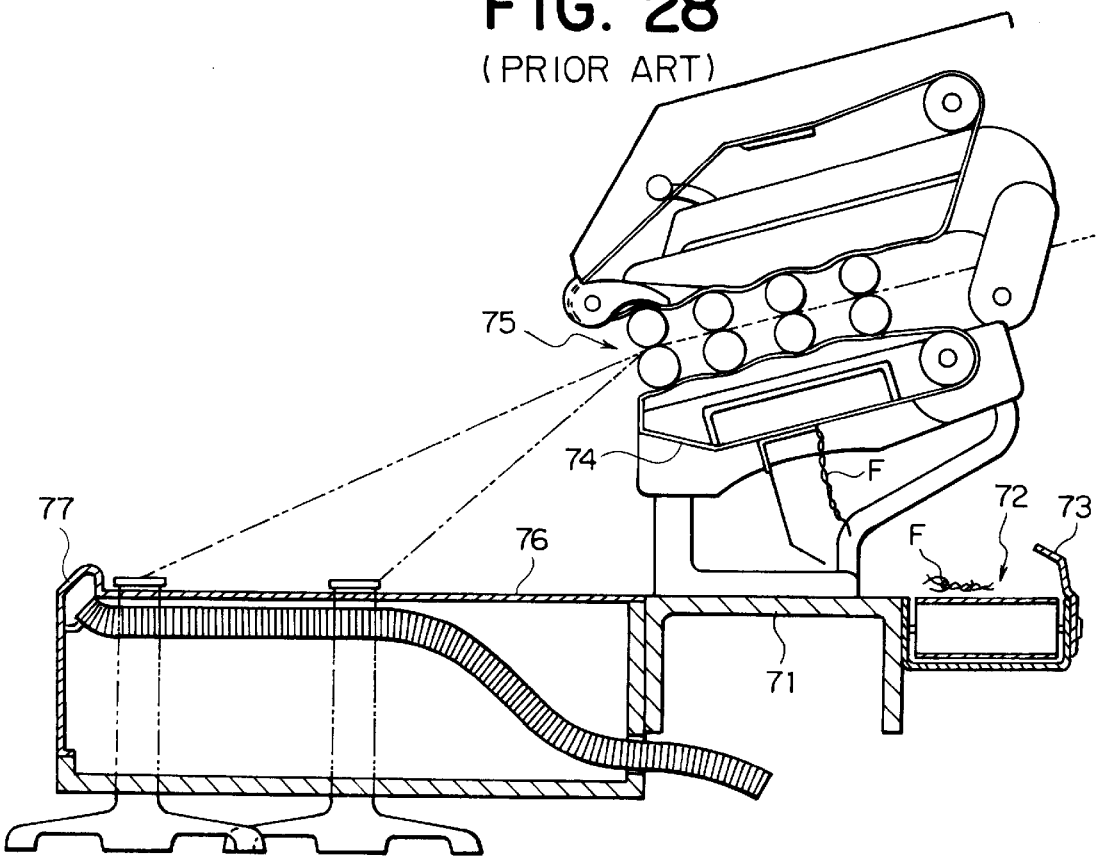
FIG. 28 (PRIOR ART)
FIG. 28 is a sectional side view showing a general structure of a conventional cleaning device for a roving apparatus utilizing a belt conveyor.
Figure 29:
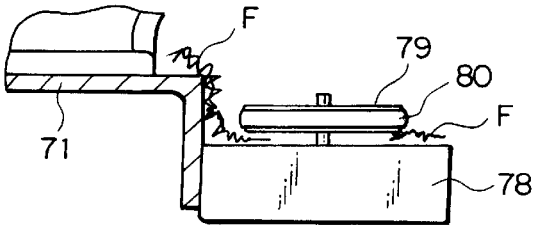
FIG. 29 (PRIOR ART)
FIG. 29 is a partial schematic view showing major components of a conventional cleaning device for a roving apparatus utilizing wheels and a tape.

(xiv) The compression member 21 may be fixed to a predetermined position as an alternative to being provided to be movable together with the scraper 9. For example, as shown in FIG. 27, a supporting piece 140*a* may be projectingly provided on a support beam 140 supporting the guide member 6*a* for the bottom clearer cloth 6, and a planar compression member 21 is fixed to the supporting piece 140*a*. The compression member 21 is preferably fixed such that a gap from the bottom clearer cloth 6 is made narrower as the compression member 21 is located away from the scraper 9. The compression member 21 is formed of a flexible material, for example, resin such as nylon or spring steel. In this case also, after the fibers scraped from the bottom clearer cloth 6 are accumulated on the compression member 21 to a certain degree, the fibers are twisted while being compressed by the action of the scraper 9 to form the worm-like fiber mass F.

(xv) The support member 10 supporting the scraper 9 is supported to be movable back and forth through the pin 11 to the bracket 8 having the elongated hole 8*a*. In place of this arrangement, a supporting rod 142 may be fixed to the support bracket 141 protruded from the support beam 140, the leading end side of the support member 10 may be elongated forward of the fixed portion of the scraper 9, and the elongated portion 10*c* may be placed on the support rod 142. In this case, in conjunction with the swinging of a link 150, the elongated portion 10*c* of the support member 10 is slid on the supporting rod 142.

(xvi) A hole may be provided above a portion of the guide plate 130 receiving the fiber mass F. In this case, if the traveling cleaner which is moved along the roving apparatus frame exists, the air flow blowing from the travelling cleaner passes through the hole to blow along the upper surface of the guide plate 130. Consequently, the air flow facilitates the movement of the fiber mass F along the guide plate 130, and even if the fiber mass F is retained on the guide plate 130, the air flow pushes that fiber mass F to facilitate the movement thereof to thereby guide that fiber mass F to the guide rail 25 more smoothly.

(xvii) In place of the arrangement where the guide plate 130 is removably attached to make it possible to carry out the maintenance work from the back side of the apparatus frame by the removal of the guide plate 130, the guide plate 130 may be arranged to be movable between a rotatable position and a non-rotatable position. In this case, simply rotating the guide plate 130 without removing it allows the maintenance work to be carried out.

(xviii) Without the use of the compression member 21 forming the fiber mass F, the fibers scraped from the bottom clearer cloth 6 may be simply suspended in a strip-like form therefrom.

(xix) The scraper 9 may be fixed to a predetermined position rather than being movable back and forth.

(xx) The shape of the scraper 9 may be modified appropriately. For example, a scraping portion of the scraper 9 may be formed into a saw shape or planar blade shape, or the scraper 9 itself may be formed into a planar plate so as to be fixed onto the upper surface of the L-shaped compression member 21. The compression member 21 may be directly fixed to the lower surface of the scraper 9.

Other aspects of the present invention that are seen from the aforementioned embodiments and their modifications will be described in connection with effects.

(1) In the fifth aspect of the present invention, the bottom part cleaning scraping member and the wall cleaning scraping member are integrally formed. In this case, the kinds of the required components can be decreased and the troublesome mounting work can be reduced in comparison with the case where the scraping members are separately provided.

(2) In any one of the first to ninth aspects of the present invention, the bottom clearer cloth cleaning part includes a scraping member reciprocally moved in the running direction of the bottom clearer cloth, and a compression member for compressing the fibers scraped from the bottom clearer cloth by the scraping member, in cooperation with the scraping member or the bottom clearer cloth. In this case, the fibers scraped from the bottom clearer cloth are compressed and formed into the worm-like fiber mass to fall without being suspended in a long strip-like form. The form of the fiber mass facilitates the movement thereof along the roller beam in comparison with the strip-like cut fibers.

(3) In any one of the first to fourth aspects of the present invention, the guide plate has a hole located above the fiber receiving portion. In this case, if the traveling cleaner moving along the frame of roving apparatus is provided, the air flow from the travelling cleaner partially passes through the hole to guide the fibers on the guide plate toward the fiber conveying means more smoothly.

(4) In any one of the first to fourth aspects of the present invention, the distance between the lower end of the guide plate and the upper surface of the roller beam is set in a range of 10 to 50 mm. In this case, the air flow blowing from the air-blowing portion formed in the flyer rail toward the rear of the roller beam can efficiently carry the fiber waste, which tends to be accumulated onto the upper surfaces of the flyer rail and the roller beam, to the fiber conveying means.

In addition, the term "fibers, etc." used in this specification is a generic term which is intended to include, but not limited to, fiber waste generated from a draft apparatus to be accumulated onto a flyer rail and a roller beam, and dust, leaf rag, and fibers scraped from a bottom clearer cloth.

Although the preferred embodiments and modifications thereof, which are currently believed to be the best mode thereof, have been described in detail with reference to the drawings, the invention should not be restricted to the specific forms of those embodiments and modifications. Various additional embodiments and modifications can be obviously realized by one having ordinary skill in the art without departing from the spirit and scope of the invention.

What is claimed is:

1. A cleaner for a roving apparatus including a bottom roller cleaning device for cleaning at least one bottom roller of a draft apparatus, said cleaner comprising:

a flyer rail;

a roller beam supporting said draft apparatus, said roller beam having a front side and a back side, wherein the front side is adjacent to the flyer rail;

a guide rail having an end, said guide rail disposed along a longitudinal direction of an apparatus frame and adjacent to the back side of the roller beam, said guide rail including:

a bottom part located below an upper surface of said roller beam; and a wall for preventing the fall of fibers, said wall spaced from and facing said back side of the roller beam, conveying means for conveying said fibers guided to said bottom part of said guide rail to an end of said guide rail, said conveying means having an engagement portion moving along said guide rail; and a collecting portion located at an end of said apparatus frame, said collecting portion collecting said fibers conveyed by said conveying means to said end of said apparatus frame.

2. A cleaner for a roving apparatus according to claim 1, wherein an upper end of said wall for preventing the fall of fibers is lower than said upper surface of said roller beam.

3. A cleaner for a roving apparatus according to claim 2, wherein the width of said guide rail decreases toward said bottom part.

4. A cleaner for a roving apparatus according to claim 2, wherein said conveying means includes:

an endless belt extended above said guide rail, and suspended between a drive pulley and a driven pulley respectively provided at first and second ends of a spinning machine frame, and wherein the engagement portion includes at least one scraping member for conveying said fibers accumulated at least on said bottom part of said guide rail toward said end of said guide rail, said at least one scraping member being larger than said endless belt and being fixed to said belt to be moved together with said belt.

5. A cleaner for a roving apparatus according to claim 2, further comprising:

a guide plate, located below said bottom roller cleaning device and inclined downward toward said guide rail, for guiding said fibers that are removed and fall from said bottom rollers to said guide rail, wherein a lower end of said guide plate extends upwardly to a position corresponding to the back side of said roller beam, and wherein said lower end of said guide plate and said upper surface of said roller beam define a gap for smoothing air flow blowing along said upper surface of said roller beam toward said guide rail.

6. A cleaner for a roving apparatus according to claim 1, wherein the width of said guide rail decreases toward said bottom part.

7. A cleaner for a roving apparatus according to claim 6, wherein said conveying means includes:

an endless belt extended above said guide rail, and suspended between a drive pulley and a driven pulley respectively provided at first and second ends of a spinning machine frame, and wherein the engagement portion includes at least one scraping member for conveying said fibers accumulated at least on said bottom part of said guide rail toward said end of said guide rail, said at least one scraping member being wider than said endless belt and being fixed to said belt to be moved together with said belt.

8. A cleaner for a roving apparatus according to claim 6, further comprising:

a guide plate, located below said bottom roller cleaning device and inclined downward toward said guide rail, for guiding said fibers that are removed and fall from said bottom rollers to said guide rail, wherein a lower end of said guide plate extends upwardly to a position corresponding to the back side of said roller beam, and wherein said lower end of said guide plate and said upper surface of said roller beam define a gap for smoothing air flow blowing along said upper surface of said roller beam toward said guide rail.

9. A cleaner for a roving apparatus according to claim 1, wherein said conveying means includes:

an endless belt extended above said guide rail, and suspended between a drive pulley and a driven pulley respectively provided at first and second ends of a spinning machine frame, wherein the drive pulley and the driven pulley each has a support shaft, and wherein the engagement portion includes at least one scraping member for conveying said fibers accumulated at least on said bottom part of said guide rail toward said end of said guide rail, said at least one scraping member being larger than said endless belt and being fixed to said belt to be moved together with said belt.

10. A cleaner for a roving apparatus according to claim 9, wherein said at least one scraping member includes:

a bottom part cleaning scraping member for conveying said fibers accumulated on said bottom part of said guide rail toward said end of said guide rail; and a wall cleaning scraping member for conveying said fibers accumulated on said wall of said guide rail toward said end of said guide rail.

11. A cleaner for a roving apparatus according to claim 10, wherein said wall cleaning scraping member is made of flexible material, and said bottom part cleaning scraping member is made of material having greater rigidity than the material of said wall cleaning scraping member.

12. A cleaner for a roving apparatus according to claim 11, further comprising:

a guide plate, located below said bottom roller cleaning device and inclined downward toward said guide rail, for guiding said fibers that are removed and fall from said bottom rollers to said guide rail, wherein a lower end of said guide plate extends upwardly to a position corresponding to the back side of said roller beam, and wherein said lower end of said guide plate and said upper surface of said roller beam define a gap for smoothing air flow blowing along said upper surface of said roller beam toward said guide rail.

13. A cleaner for a roving apparatus according to claim 10, further comprising:

a guide plate, located below said bottom roller cleaning device and inclined downward toward said guide rail, for guiding said fibers that are removed and fall from said bottom rollers to said guide rail, wherein a lower end of said guide plate extends upwardly to a position corresponding to the back side of said roller beam, and wherein said lower end of said guide plate and said upper surface of said roller beam define a gap for smoothing air flow blowing along said upper surface of said roller beam toward said guide rail.

14. A cleaner for a roving apparatus according to claim 9, wherein said drive pulley is driven by a motor dedicated as a drive source for said conveying means.

15. A cleaner for a roving apparatus according to claim 9, wherein each of the support shafts for said drive pulley and said driven pulley disposed horizontally.

16. A cleaner for a roving apparatus according to claim 9, wherein each of the support shafts for said drive pulley and said driven pulley disposed vertically.

17. A cleaner for a roving apparatus according to claim 9, further comprising:

a guide plate, located below said bottom roller cleaning device and inclined downward toward said guide rail, for guiding said fibers that are removed and fall from said bottom rollers to said guide rail, wherein a lower end of said guide plate extends upwardly to a position corresponding to the back side of said roller beam, and wherein said lower end of said guide plate and said upper surface of said roller beam define a gap for smoothing air flow blowing along said upper surface of said roller beam toward said guide rail.

18. A cleaner for a roving apparatus according to claim 1, further comprising:

a guide plate, located below said bottom roller cleaning device and inclined downward toward said guide rail, for guiding said fibers that are removed and fall from said bottom rollers, to said guide rail, wherein a lower end of said guide plate extends upwardly to a position corresponding to the back side of said roller beam, and wherein said lower end of said guide plate and said upper surface of said roller beam define a gap for smoothing air flow blowing along said upper surface of said roller beam toward said guide rail.

19. A cleaner for a roving apparatus according to claim 18, wherein said bottom roller cleaning device includes a cloth scraping member movable back and forth in a direction perpendicular to an axial direction of said at least one bottom roller by driving means, and said guide plate is movable together with said scraping member.

20. A cleaner for a roving apparatus according to claim 18, wherein said bottom roller cleaning device includes:

a bottom clearer cloth movable while being kept in contact with said at least one bottom roller;

a cloth scraping member, reciprocally movable in a running direction while being in contact with an outer periphery of said bottom clearer cloth, for scraping said fibers adhered to said bottom clearer cloth; and a compression member for compressing said fibers scraped from said bottom clearer cloth by said cloth scraping member, said compression member cooperating with said cloth scraping member and said bottom clearer cloth as said cloth scraping member is moved toward a leading end of said compression member.

* * * * *

UNITED STATES PATENT AND TRADEMARK OFFICE

CERTIFICATE OF CORRECTION

PATENT NO. : 6,082,088
DATED : July 4, 2000
INVENTOR(S) : Ohoka et al.

It is certified that error appears in the above-identified patent and that said Letters Patent is hereby corrected as shown below:

Column 1,
Line 27, "then-carried" should read -- then carried --

Column 2,
Line 22, "from-the" should read -- from the --
Line 29, "performs cleaning" should read -- performs a cleaning --

Column 5,
Line 44, "gear end side" should read -- gear end with --

Column 6,
Line 4, "plane view" should read -- plan view --

Column 7,
Line 17, "9-958830" should read -- 9-95830 --

Column 9,
Line 36, "pulley is rotated" should read -- pulley 15 is rotated --
Line 47, "the-eccentric" should read -- the eccentric --

Column 11,
Line 8, guide rail 25, and," should read -- guide rail 25, and --

Column 13,
Line 60, "gear end," should read -- gear end --

Column 20,
Line 27, "the-drive" should read -- the drive --

UNITED STATES PATENT AND TRADEMARK OFFICE

CERTIFICATE OF CORRECTION

PATENT NO. : 6,082,088
DATED : July 4, 2000
INVENTOR(S) : Ohoka et al.

It is certified that error appears in the above-identified patent and that said Letters Patent is hereby corrected as shown below:

Column 24,
Line 67, "pulley disposed" should read -- pulley is disposed --

Column 25,
Line 3, "pulley disposed" should read -- pulley is disposed --

Signed and Sealed this

Twenty-sixth Day of March, 2002

*Attest:*

*Attesting Officer*

JAMES E. ROGAN
*Director of the United States Patent and Trademark Office*